US010159277B2

(12) United States Patent
Bonnely

(10) Patent No.: US 10,159,277 B2
(45) Date of Patent: Dec. 25, 2018

(54) SMOKING ARTICLE WITH NON-OVERLAPPING, RADIALLY SEPARATED, DUAL HEAT-CONDUCTING ELEMENTS

(71) Applicant: PHILIP MORRIS PRODUCTS S.A., Neuchatel (CH)

(72) Inventor: Samuel Bonnely, Cormondreche (CH)

(73) Assignee: PHILIP MORRIS PRODUCTS S.A., Neuchatel (CH)

( * ) Notice: Subject to any disclaimer, the term of this patent is extended or adjusted under 35 U.S.C. 154(b) by 0 days.

(21) Appl. No.: 14/915,769

(22) PCT Filed: Sep. 1, 2014

(86) PCT No.: PCT/EP2014/068482

§ 371 (c)(1),
(2) Date: Mar. 1, 2016

(87) PCT Pub. No.: WO2015/028654

PCT Pub. Date: Mar. 5, 2015

(65) Prior Publication Data

US 2016/0192704 A1 Jul. 7, 2016

(30) Foreign Application Priority Data

Sep. 2, 2013 (EP) ..... 13182663

(51) Int. Cl.
*A24F 47/00* (2006.01)
*A24D 1/02* (2006.01)

(52) U.S. Cl.
CPC ..... *A24F 47/006* (2013.01); *A24D 1/02* (2013.01); *A24D 1/027* (2013.01)

(58) Field of Classification Search
CPC ..... A24F 47/006; A24D 1/02; A24D 1/027
See application file for complete search history.

(56) References Cited

U.S. PATENT DOCUMENTS 4,966,171 A * 10/1990 Serrano ..... A24B 15/165 131/194
5,040,551 A 8/1991 Schlatter et al.
5,415,186 A * 5/1995 Casey, III ..... A24B 15/14 131/194
5,546,965 A * 8/1996 White ..... A24F 47/004 131/194
2009/0065011 A1 3/2009 Maeder et al.
2012/0067360 A1 3/2012 Conner et al.
2013/0146075 A1 6/2013 Poget et al.

(Continued)

FOREIGN PATENT DOCUMENTS

CN 1039710 A 2/1990
CN 1575136 A 2/2005

(Continued)

OTHER PUBLICATIONS

International Search Report and Written Opinion of the International Searching Authority dated Nov. 14, 2014 in PCT/EP14/68482 Filed Sep. 1, 2014.

(Continued)

*Primary Examiner* — Edwin A. Leon
*Assistant Examiner* — Oscar Jimenez
(74) *Attorney, Agent, or Firm* — Oblon, McClelland, Maier & Neustadt, L.L.P.

(57) ABSTRACT

A smoking article is provided, including a combustible heat source having opposed front and rear faces; an aerosol-forming substrate downstream of the rear face of the heat source; a first heat-conducting element including one or more radially inner layers of heat-conductive material overlying a rear portion of the combustible heat source; and a second heat-conducting element including one or more radially outer layers of heat-conductive material overlying at least a portion of the aerosol-forming substrate, such that the one or more radially outer layers of heat-conductive material do not overlie the one or more radially inner layers of heat-conductive material.

19 Claims, 2 Drawing Sheets

(56) References Cited

U.S. PATENT DOCUMENTS

| | | | | |
|---|---|---|---|---|
| 2014/0283860 | A1* | 9/2014 | Stolz | A24B 15/165 131/330 |
| 2014/0326260 | A1* | 11/2014 | Gladden | A24B 15/165 131/329 |
| 2015/0013697 | A1* | 1/2015 | Mironov | A24B 15/165 131/328 |
| 2015/0053219 | A1* | 2/2015 | Roudier | A24F 47/008 131/329 |
| 2015/0122273 | A1* | 5/2015 | Mironov | A24D 3/0287 131/328 |
| 2015/0201670 | A1* | 7/2015 | Crooks | A24D 1/002 131/88 |
| 2016/0316816 | A1* | 11/2016 | Lavanchy | A24D 1/02 |

FOREIGN PATENT DOCUMENTS

| | | | |
|---|---|---|---|
| WO | WO 2009/022232 | A2 | 2/2009 |
| WO | WO 2009/074870 | A2 | 6/2009 |
| WO | 2011/117750 | A2 | 9/2011 |
| WO | WO 2012/164077 | A1 | 12/2012 |
| WO | WO 2013/120849 | A1 | 8/2013 |

OTHER PUBLICATIONS

Combined Office Action and Search Report dated Mar. 15, 2018 in Chinese Patent Application No. 201480045916.7 (with English language translation), 17 pages.

* cited by examiner

SMOKING ARTICLE WITH NON-OVERLAPPING, RADIALLY SEPARATED, DUAL HEAT-CONDUCTING ELEMENTS

The present invention relates to a smoking article comprising a combustible heat source having opposed front and rear faces, an aerosol-forming substrate downstream of the rear face of the combustible heat source and non-overlapping, radially separated, dual heat-conducting elements.

A number of smoking articles in which tobacco is heated rather than combusted have been proposed in the art. One aim of such 'heated' smoking articles is to reduce known harmful smoke constituents of the type produced by the combustion and pyrolytic degradation of tobacco in conventional cigarettes. In one known type of heated smoking article, an aerosol is generated by the transfer of heat from a combustible heat source to an aerosol-forming substrate. The aerosol-forming substrate may be located within, around or downstream of the combustible heat source. During smoking, volatile compounds are released from the aerosol-forming substrate by heat transfer from the combustible heat source and entrained in air drawn through the smoking article. As the released compounds cool, they condense to form an aerosol that is inhaled by the user. Typically, air is drawn into such known heated smoking articles through one or more airflow channels provided through the combustible heat source and heat transfer from the combustible heat source to the aerosol-forming substrate occurs by forced convection and conduction.

For example, WO-A2-2009/022232 discloses a smoking article comprising a combustible heat source, an aerosol-forming substrate downstream of the combustible heat source, and a heat-conducting element around and in direct contact with a rear portion of the combustible heat source and an adjacent front portion of the aerosol-forming substrate. The smoking article may further comprise a sleeve around part of the rear portion of the aerosol-generating substrate. The sleeve is downstream of and spaced apart from the heat-conducting element. WO-A2-2009/022232 discloses that the sleeve may serve as a barrier material and prevent migration of the aerosol former to the outer surface of the smoking article. WO-A2-2009/022232 also discloses that the sleeve may serve to slightly modulate the steepness of the temperature gradient along the length of the aerosol-generating substrate by retaining heat in the rear portion of the aerosol-generating substrate and thus slightly reducing the steepness of the temperature gradient.

The heat-conducting element in the smoking article of WO-A2-2009/022232 transfers heat generated during combustion of the combustible heat source to the aerosol-forming substrate by conduction. The heat drain exerted by the conductive heat transfer significantly lowers the temperature of the rear portion of the combustible heat source so that the temperature of the rear portion is retained significantly below its self-ignition temperature.

In smoking articles in which tobacco is heated rather than combusted, the temperature attained in the aerosol-forming substrate has a significant impact on the ability to generate a sensorially acceptable aerosol. It is typically desirable to maintain the temperature of the aerosol-forming substrate within a certain range in order to optimise the aerosol delivery to a user. In some cases, radiative heat losses from the outer surface of a heat-conducting element around and in direct contact with the combustible heat source and the aerosol-forming substrate may cause the temperature of the combustible heat source and the aerosol-forming substrate to drop outside of a desired range, thereby impacting the performance of the smoking article. If the temperature of the aerosol-forming substrate drops too low, for instance, it may adversely impact the consistency and the amount of aerosol delivered to a user.

In some heated smoking articles, forced convective heat transfer from a combustible heat source to the aerosol-forming substrate is provided in addition to conductive heat transfer via a heat-conducting element. For example, in some known heated smoking articles one or more airflow channels are provided along the combustible heat source in order to provide forced convective heating of the aerosol-forming substrate. In such smoking articles, the aerosol-forming substrate is heated by a combination of conductive heating and forced convective heating. For example, WO-A2-2009/022232 discloses providing at least one longitudinal airflow channel through the combustible heat source to provide a controlled amount of forced convective heating of the aerosol-forming substrate.

In known heated smoking articles in which heat transfer from the combustible heat source to the aerosol-forming substrate occurs primarily by forced convection, the forced convective heat transfer and hence the temperature in the aerosol-forming substrate can vary considerably depending upon the puffing behaviour of a user. As a result, the composition and hence the sensory properties of the mainstream aerosol generated by such known heated smoking articles may disadvantageously be highly sensitive to a user's puffing regime.

In particular, in known heated smoking articles comprising one or more airflow channels along the combustible heat source, direct contact between air drawn through the one or more airflow channels and the combustible heat source during puffing by a user results in activation of combustion of the combustible heat source. Intense puffing regimes may therefore lead to sufficiently high forced convective heat transfer to cause spikes in the temperature of the aerosol-forming substrate, disadvantageously leading to pyrolysis and potentially even localised combustion of the aerosol-forming substrate. As used herein, the term 'spike' is used to describe a short-lived increase in the temperature of the aerosol-forming substrate. As a result, the levels of undesirable pyrolytic and combustion by-products in the mainstream aerosols generated by such known heated smoking articles may also disadvantageously vary significantly depending upon the particular puffing regime adopted by a user.

In other heated smoking articles, no airflow channels are provided through the combustible heat source. In such heated smoking articles heating of the aerosol-forming substrate is achieved primarily by conductive heat transfer via a heat-conducting element. In heated smoking articles where the aerosol-forming substrate is heated primarily by conductive heat transfer, the temperature of the aerosol-forming substrate can become more sensitive to changes in the temperature of the heat-conducting element. This means that any cooling of a heat-conducting element around and in direct contact with the combustible heat source and the aerosol-forming substrate due to radiative heat loss in such heated smoking articles may have a greater impact on the aerosol generation than in heated smoking articles where the aerosol-forming substrate is also heated by forced convective heat transfer.

It is known to include additives in the combustible heat sources of heated smoking articles in order to improve the ignition and combustion properties of the combustible heat sources. However, the inclusion of ignition and combustion additives can give rise to decomposition and reaction products, which may disadvantageously enter air drawn through such known heated smoking articles during use thereof.

To facilitate aerosol formation, the aerosol-forming substrates of heated smoking articles typically comprise a polyhydric alcohol, such as glycerine, or other known aerosol-formers. During storage and smoking, such aerosol-formers may migrate from the aerosol-forming substrates of known heated smoking articles to the combustible heat sources thereof. Migration of aerosol-formers to the combustible heat sources of known heated smoking articles can disadvantageously lead to decomposition of the aerosol-formers, particularly during smoking of the heated smoking articles.

It would be desirable to provide a heated smoking article including a combustible heat source having opposed front and rear faces and an aerosol-forming substrate downstream of the rear face of the combustible heat source, which provides improved smoking performance. In particular, it would be desirable to provide a heated smoking article in which there is improved control of the heating of the aerosol-forming substrate in order to help maintain the temperature of the aerosol-forming substrate within a desired temperature range during smoking.

According to the invention there is provided a smoking article comprising: a combustible heat source having opposed front and rear faces; an aerosol-forming substrate downstream of the rear face of the combustible heat source; a first heat-conducting element comprising one or more radially inner layers of heat-conductive material overlying a rear portion of the combustible heat source; and a second heat-conducting element comprising one or more radially outer layers of heat-conductive material overlying at least a portion of the aerosol-forming substrate. The one or more radially outer layers of heat-conductive material do not overlie the one or more radially inner layers of heat-conductive material.

As used herein, the terms 'distal', 'upstream' and 'front', and 'proximal', 'downstream' and 'rear', are used to describe the relative positions of components, or portions of components, of the smoking article in relation to the direction in which a user draws on the smoking article during use thereof. Smoking articles according to the invention comprise a proximal end through which, in use, an aerosol exits the smoking article for delivery to a user. The proximal end of the smoking article may also be referred to as the mouth end. In use, a user draws on the proximal end of the smoking article in order to inhale an aerosol generated by the smoking article.

The combustible heat source is located at or proximate to the distal end. The mouth end is downstream of the distal end. The proximal end may also be referred to as the downstream end of the smoking article and the distal end may also be referred to as upstream end of the smoking article. Components, or portions of components, of smoking articles according to the invention may be described as being upstream or downstream of one another based on their relative positions between the proximal end and the distal end of the smoking article.

The front face of the combustible heat source is at the upstream end of the combustible heat source. The upstream end of the combustible heat source is the end of the combustible heat source furthest from the proximal end of the smoking article. The rear face of the combustible heat source is at the downstream end of the combustible heat source. The downstream end of the combustible heat source is the end of the combustible heat source closest to the proximal end of the smoking article.

As used herein, the term 'aerosol-forming substrate' is used to describe a substrate capable of releasing upon heating volatile compounds, which can form an aerosol. The aerosols generated from aerosol-forming substrates of smoking articles according to the invention may be visible or invisible and may include vapours (for example, fine particles of substances, which are in a gaseous state, that are ordinarily liquid or solid at room temperature) as well as gases and liquid droplets of condensed vapours.

The aerosol-forming substrate may be in the form of a plug or segment comprising a material capable of releasing upon heating volatile compounds, which can form an aerosol, circumscribed by a wrapper. Where an aerosol-forming substrate is in the form of such a plug or segment, the entire plug or segment including the wrapper is considered to be the aerosol-forming substrate.

The first heat-conducting element comprises one or more radially inner layers of heat-conductive material and the second heat-conducting element comprises one or more radially outer layers of heat-conductive material.

As used herein, the terms 'radially outer' and 'radially inner' are used to indicate that the radial distance between the longitudinal axis of the smoking article and the one or more radially outer layers of heat-conductive material of the second heat conducting element is greater than the radial distance between the longitudinal axis of the smoking article and the one or more radially inner layers of heat-conductive material of the first heat-conducting element.

As used herein, the term 'longitudinal' is used to describe the direction between the proximal end and the opposed distal end of the smoking article.

As used herein, the term 'radial' is used to describe the direction perpendicular to the direction between the proximal end and the opposed distal end of the smoking article.

As used herein, the term 'length' is used to describe the maximum dimension in the longitudinal direction of the smoking article. That is, the maximum dimension in the direction between the proximal end and the opposed distal end of the smoking article.

Smoking articles according to the invention comprise a first heat-conducting element comprising one or more radially inner layers of heat-conductive material overlying a rear portion of the combustible heat source and a second heat-conducting element comprising one or more radially outer layers of heat-conductive material overlying at least a portion of the aerosol-forming substrate. The one or more radially outer layers of heat-conductive material of the second heat-conducting element do not overlie the one or more radially inner layers of heat-conductive material of the first heat-conducting element.

In smoking articles according to the invention there is no direct contact between the one or more radially outer layers of heat-conductive material of the second heat-conducting element and the one or more radially inner layers of heat-conductive material of the first heat-conducting element. This limits or inhibits conductive heat transfer from the first heat-conducting element to the second heat-conducting element. As used herein, the term 'direct contact' is used to mean contact between two components without any intermediate material, such that the surfaces of the components are touching each other.

The inclusion of a second heat-conducting element comprising one or more radially outer layers of heat-conductive material advantageously substantially reduces radiative heat losses from outer surfaces of smoking articles according to the invention compared to smoking articles of the type disclosed in WO-A2-2009/022232 comprising a heat-conducting element and a radially aligned sleeve downstream of and spaced apart from the heat-conducting element.

By reducing radiative heat losses from outer surfaces of smoking articles according to the invention, the inclusion of a second heat-conducting element comprising one or more radially outer layers of heat-conductive material advantageously improves control over the drain and distribution of heat from the combustible heat source to the aerosol-forming substrate of smoking articles according to the invention. In particular, by reducing radiative heat losses from outer surfaces of smoking articles according to the invention, the inclusion of a second heat-conducting element comprising one or more radially outer layers of heat-conductive material helps to better maintain the temperature of the aerosol-forming substrate within a desired temperature range.

The inclusion of a second heat-conducting element comprising one or more radially outer layers of heat-conductive material improves the generation of aerosol from the aerosol-forming substrate. Advantageously, the inclusion of a second heat-conducting element comprising one or more radially outer layers of heat-conductive material increases the overall delivery of aerosol to a user. In particular, it can be seen that where the aerosol-forming substrate comprises nicotine, the nicotine delivery to a user can be significantly improved through the inclusion of a second heat-conducting element comprising one or more radially outer layers of heat-conductive material. In addition, the inclusion of a second heat-conducting element comprising one or more radially outer layers of heat-conductive material has been found to advantageously extend the smoking duration of the smoking article so that a greater number of puffs can be taken by a user.

The improvement in the temperature profile of smoking articles according to the invention achieved through the inclusion of a second heat-conducting element comprising one or more radially outer layers of heat-conductive material is particularly beneficial for smoking articles according to the invention in which there is substantially no forced convective heat transfer.

The one or more radially inner layers of heat-conductive material of the first heat-conducting element may overlie a rear portion of the combustible heat source and at least a front portion of the aerosol-forming substrate. In such embodiments, the one or more radially outer layers of heat-conductive material of the second heat-conducting element overlie a rear portion of the aerosol-forming substrate.

Alternatively, the one or more radially inner layers of heat-conductive material of the first heat-conducting element may overlie only a rear portion of the combustible heat source. In such embodiments, the one or more radially outer layers of heat-conductive material of the second heat-conducting element may overlie only a portion of the aerosol-forming substrate or the entire length of the aerosol-forming substrate.

In certain embodiments the one or more radially inner layers of heat-conductive material of the first heat-conducting element may overlie a rear portion of the combustible heat source and the one or more radially outer layers of heat-conductive material of the second heat-conducting element may overlie the entire length of the aerosol-forming substrate.

In smoking articles according to the invention the one or more radially outer layers of heat-conductive material of the second heat-conducting element are downstream of the one or more radially inner layers of heat-conductive material of the first heat-conducting element.

The one or more radially outer layers of heat-conductive material of the second heat-conducting element may be immediately downstream of the one or more radially inner layers of heat-conductive material of the first heat-conducting element. In such embodiments, the upstream ends of the one or more radially outer layers of heat-conductive material of the second heat-conducting element are substantially longitudinally aligned with the downstream ends of the one or more radially inner layers of heat-conductive material of the first heat-conducting element.

Alternatively, the one or more radially outer layers of heat-conductive material of the second heat-conducting element may be longitudinally spaced apart from the one or more radially inner layers of heat-conductive material of the first heat-conducting element. In such embodiments, the upstream ends of the one or more radially outer layers of heat-conductive material of the second heat-conducting element are longitudinally spaced apart from the downstream ends of the one or more radially inner layers of heat-conductive material of the first heat-conducting element.

For example, the upstream ends of the one or more radially outer layers of heat-conductive material of the second heat-conducting element and the downstream ends of the one or more radially inner layers of heat-conductive material of the first heat-conducting element may be longitudinally spaced apart by between about 0.5 mm and about 4 mm.

The first heat-conducting element may comprise a radially inner layer of heat-conductive material around and in direct contact with a rear portion of the combustible heat source. In such embodiments, the rear portion of the combustible heat source is circumscribed by and is in direct contact with the radially inner layer of heat-conductive material of the first heat-conducting element.

In certain embodiments, the first heat-conducting element may comprise a radially inner layer of heat-conductive material around and in direct contact with a rear portion of the combustible heat source and at least a front portion of the aerosol-forming substrate. In such embodiments, the rear portion of the combustible heat source is circumscribed by and is in direct contact with the radially inner layer of heat-conductive material of the first heat-conducting element and at least a front portion of the aerosol-forming substrate is circumscribed by and is in direct contact with the radially inner layer of heat-conductive material of the first heat-conducting element. In such embodiments, the first heat-conducting element provides a thermal link between the combustible heat source and aerosol-forming substrate of smoking articles according to the invention.

In other embodiments, the one or more radially inner layers of heat-conductive material of the first heat-conducting element may be radially separated from the combustible heat source. As used herein, the term 'radially separated' is used to indicate that the one or more radially inner layers of heat-conductive material of the first heat-conducting element are spaced apart from the combustible heat source in a radial direction, such that there is no direct contact between the one or more radially inner layers of heat-conductive material of the first heat-conducting element and the combustible heat source.

The first heat-conducting element and the second heat-conducting element may be radially separated by one or more layers of heat-insulative material. Suitable heat-insulative materials include, but are not limited to, paper, ceramics and metal oxides.

In such embodiments, the one or more layers of heat-insulative material overlie at least a portion of the first heat-conducting element and underlie at least a portion of the second heat-conducting element. In certain embodiments, the first heat-conducting element and the second heat-conducting element may be radially separated by one or more layers of heat-insulative material that overlie the entire length of the first heat-conducting element and underlie the entire length of the second heat-conducting element.

For example, the first heat-conducting element may be covered by a wrapper that circumscribes the smoking article along at least a portion of its length. In such embodiments, the wrapper is wrapped around the smoking article over the first heat-conducting element and the second heat-conducting element is then provided over at least a portion of the wrapper.

In certain preferred embodiments, the second heat-conducting element is provided on the outside of the smoking article, such that the second heat-conducting element is visible on the exterior of the smoking article. In certain particularly preferred embodiments, a radially outer layer of heat-conductive material of the second heat-conducting element is provided on the outside of the smoking article, such that the radially outer layer of heat-conductive material of the second heat-conducting element is visible on the exterior of the smoking article.

Alternatively, an outer wrapper that extends along all or just a part of the smoking article may be provided over the second heat-conducting element, such that the second heat-conducting element is not visible or only partly visible on the exterior of the smoking article.

The provision of the second heat-conducting element over a wrapper of the smoking article may provide benefits in relation to the appearance of smoking articles according to the invention, in particular during and after smoking thereof. In certain cases, some discolouration of the wrapper in the region of the combustible heat source may be observed when the wrapper is exposed to heat from the combustible heat source. The wrapper may additionally be discoloured as a result of the migration of volatile compounds from the aerosol-forming substrate into the wrapper around and downstream of the aerosol-forming substrate. In certain embodiments, the one or more radially outer layers of heat-conductive material of the second heat-conducting element may be provided over the wrapper around at least a portion of the aerosol-forming substrate so that discolouration of the wrapper is covered and no longer visible or less visible. In certain embodiments, the one or more radially outer layers of heat-conductive material of the second heat-conducting element may extend around the entire length of the aerosol-forming substrate. In certain preferred embodiments, the one or more radially outer layers of heat-conductive material of the second heat-conducting element may extend downstream beyond the aerosol-forming substrate. The initial appearance of the smoking article can therefore be retained during smoking.

The first heat-conducting element is preferably combustion resistant. In certain embodiments, the first heat-conducting element is oxygen restricting. In such embodiments, the first heat-conducting element inhibits or resists the passage of oxygen through the first heat-conducting element to the combustible heat source.

The first heat-conducting element may extend around all or a part of the circumference of the smoking article. Preferably, the first heat-conducting element forms a continuous sleeve that tightly circumscribes a rear portion of the combustible heat source.

In certain embodiments, the first heat-conducting element may form a continuous sleeve that tightly circumscribes a rear portion of the combustible heat source and a front portion of the aerosol-forming substrate. In such embodiments, the first heat-conducting element may provide a substantially airtight connection between the combustible heat source and the aerosol-forming substrate. This may advantageously prevent or inhibit combustion gases from the combustible heat source being readily drawn into the aerosol-forming substrate through its periphery. Such a connection may also advantageously minimise or substantially avoid forced convective heat transfer from the combustible heat source to the aerosol-forming substrate by air drawn along the peripheries of the combustible heat source and the aerosol-forming substrate.

Preferably, the physical integrity of the first heat-conducting element is maintained at temperatures achieved by the combustible heat source during ignition and combustion. In embodiments in which the first heat-conducting element provides a substantially airtight connection between the combustible heat source and the aerosol-forming substrate, this advantageously helps to maintain the airtight connection during use of the smoking article.

The one or more radially inner layers of heat-conductive material of the first heat-conducting element may comprise any suitable heat-conductive material or combination of materials with an appropriate thermal conductivity.

Preferably, the one or more radially inner layers of heat-conductive material of the first heat-conducting element comprise heat-conductive materials having a bulk thermal conductivity of between about 10 W per meter Kelvin (W/(m·K)) and about 500 W per meter Kelvin (W/(m·K)), more preferably between about 15 W per meter Kelvin (W/(m·K)) and about 400 W per meter Kelvin (W/(m·K)), at 23° C. and a relative humidity of 50% as measured using the modified transient plane source (MTPS) method. Suitable heat-conductive materials include, but are not limited to: metal foil wrappers such as, for example, aluminium foil wrappers, steel foil wrappers, iron foil wrappers and copper foil wrappers; and metal alloy foil wrappers.

In certain preferred embodiments, the first heat-conducting element comprises one or more layers of aluminium.

The first heat-conducting element may be formed of a single layer of heat-conductive material. Alternatively, the first heat-conducting element may be formed of a multilayer or laminate material comprising at least one layer of heat-conductive material in combination with one or more other heat-conducting layers or non-heat-conducting layers. In such embodiments, the at least one layer of heat-conductive material may comprise any of the heat-conductive materials listed above.

In certain embodiments, the first heat-conducting element may be formed of a laminate material comprising at least one layer of heat-conductive material and at least one layer of heat-insulative material. In such embodiments, the inner layer of the first heat-conducting element facing the rear portion of the combustible heat may be a layer of heat-conductive material.

One example of a particularly suitable laminate material for forming the first heat-conducting element is a double layer laminate material comprising an outer layer of paper and an inner layer of aluminium.

Preferably the thickness of the first heat-conducting element is between about 5 microns and about 100 microns, more preferably between about 10 microns and about 50 microns even more preferably between about 10 microns and about 30 microns and most preferably about 20 microns.

In certain particularly preferred embodiments, the first heat-conducting element comprises aluminium foil having a thickness of about 20 microns.

Preferably, the rear portion of the combustible heat source surrounded by the one or more radially inner layers of heat-conductive material of the first heat-conducting element is between about 2 mm and about 8 mm in length, more preferably between about 3 mm and about 5 mm in length.

Preferably, the front portion of the combustible heat source not surrounded by the one or more radially inner layers of heat-conductive material of the first heat-conducting element is between about 4 mm and about 15 mm in length, more preferably between about 5 mm and about 8 mm in length.

In embodiments in which the first heat-conducting element comprises one or more radially inner layers of heat-conductive material surrounding a rear portion of the combustible heat source and a front portion of the aerosol-forming substrate, the aerosol-forming substrate preferably extends at least about 3 mm downstream beyond the one or more radially inner layers of heat-conductive material of the first heat-conducting element. More preferably, the aerosol-forming substrate extends between about 3 mm and about 10 mm downstream beyond the one or more radially inner layers of heat-conductive material of the first heat-conducting element. Most preferably, the aerosol-forming substrate extends between about 5 mm and about 8 mm downstream beyond the one or more radially inner layers of heat-conductive material of the first heat-conducting element.

In such embodiments, the front portion of the aerosol-forming substrate surrounded by the one or more radially inner layers of heat-conductive material of the first heat-conducting element is preferably between about 1 mm and about 10 mm in length, more preferably between about 2 mm and about 8 mm in length, most preferably between about 2 mm and about 6 mm in length.

The second heat-conducting element may extend around all or a part of the circumference of the smoking article. Preferably, the second heat-conducting element forms a continuous sleeve that circumscribes at least a portion of the aerosol-forming substrate.

The one or more radially outer layers of heat-conductive material of the second heat-conducting element may comprise any suitable heat-conductive material or combination of materials with an appropriate thermal conductivity.

Preferably, the one or more radially outer layers of heat-conductive material of the second heat-conducting element comprise heat-conductive materials having a bulk thermal conductivity of between about 10 W per meter Kelvin (W/(m·K)) and about 500 W per meter Kelvin (W/(m·K)), more preferably between about 15 W per meter Kelvin (W/(m·K)) and about 400 W per meter Kelvin (W/(m·K)), at 23° C. and a relative humidity of 50% as measured using the modified transient plane source (MTPS) method. Suitable heat-conductive materials include, but are not limited to: metal foil wrappers such as, for example, aluminium foil wrappers, steel foil wrappers, iron foil wrappers and copper foil wrappers; and metal alloy foil wrappers.

In certain preferred embodiments, the second heat-conducting element comprises one or more layers of aluminium.

The one or more radially inner layers of heat-conductive material of the first heat-conducting element and the one or more radially outer layers of heat-conductive material of the second heat-conducting element may comprise the same or different heat-conductive material or materials.

Preferably, the one or more radially outer layers of heat-conductive material of the second heat-conducting element comprise a heat reflective material, such as aluminium or steel. In such embodiments, in use, the one or more radially outer layers of heat-conductive material second heat-conducting element advantageously reflect heat radiating from the aerosol-forming substrate back towards the aerosol-forming substrate.

As used herein the term 'heat reflective material' refers to a material that has a relatively high heat reflectivity and a relatively low heat emissivity such that the material reflects a greater proportion of incident radiation from its surface than it emits. Preferably, the heat reflective material reflects more than 50% of incident radiation, more preferably more than 70% of incident radiation and most preferably more than 75% of incident radiation.

In such embodiments, the relatively high heat reflectivity and relatively low heat emissivity of the one or more radially outer layers of heat-conductive material of the second heat-conducting element reduces heat losses from the aerosol-forming substrate.

The reflectivity of the one or more radially outer layers of heat-conductive material of the second heat-conducting element may be improved by providing the one or more radially outer layers of heat-conductive material of the second heat-conducting element with a shiny inner surface, wherein the inner surface is the surface that faces the aerosol-forming substrate.

The second heat-conducting element may be formed of a single layer of heat-conductive material. Alternatively, the second heat-conducting element may be formed of a multilayer or laminate material comprising at least one layer of heat-conductive material in combination with one or more other heat-conducting layers or non-heat-conducting layers. In such embodiments, the at least one layer of heat-conductive material may comprise any of the heat-conductive materials listed above.

In certain preferred embodiments, the second heat-conducting element may be formed of a laminate material comprising at least one layer of heat-conductive-material and at least one layer of heat-insulative material. In such embodiments, the inner layer of the second heat-conducting element facing the aerosol-forming substrate may be a layer of heat-insulative material.

In certain preferred embodiments, the second heat-conducting element comprises a single layer of heat-conductive material.

In certain preferred embodiments, the second heat-conducting element is a laminate material comprising a single layer of heat-conductive material and one or more layers of heat-insulative material. In certain particularly preferred embodiments, the second heat-conducting element is a laminate material comprising a single layer of heat-conductive material and a single layer of heat-insulative material. Preferably, the second heat-conducting element is a laminate material comprising a single outer layer of heat-conductive material and a single inner layer of heat-insulative material.

One example of a particularly suitable laminate material for forming the second heat-conducting element is a double layer laminate material comprising an outer layer of aluminium and an inner layer of paper.

The use of a second heat-conducting element comprising a laminate material may be beneficial during the production of the smoking articles according to the invention, since the at least one layer of heat-insulative material may provide added strength and rigidity. This enables the laminate material to be processed more easily, with a reduced risk of collapse or breakage of the at least one layer of heat-conductive material, which may be relatively thin and fragile.

The thickness of the second heat-conducting element may be substantially the same as the thickness of the first heat-conducting element. Alternatively, the first heat-conducting element and the second heat-conducting element may have different thicknesses to each other.

Preferably the thickness of the second heat-conducting element is between about 5 microns and about 100 microns, more preferably between about 10 microns and about 80 microns.

Preferably, the second heat-conducting element comprises one or more radially outer layers of heat-conductive material having a thickness of between about 2 microns and about 50 microns, more preferably between about 5 microns and about 30 microns, most preferably between about 5 microns and about 20 microns.

In certain embodiments, the second heat-conducting element may comprise aluminium foil having a thickness of about 20 microns.

In certain preferred embodiments, the second heat-conducting element may comprise a laminate material comprising an outer layer of aluminium having a thickness of between about 2 microns and about 20 microns, more preferably of between about 4 microns and about 10 microns, most preferably of between about 5 microns and about 8 microns and an inner layer of paper.

The position and extent of the second heat-conducting element relative to the first heat-conducting element and the aerosol-forming substrate may be adjusted in order to control heating of the aerosol-forming substrate during smoking.

In certain embodiments, the second heat-conducting element may comprise one or more radially outer layers of heat-conductive material overlying the entire length of the aerosol-forming substrate. In such embodiments, the downstream ends of the one or more radially outer layers of heat-conductive material of the second heat-conducting element may be aligned with the downstream end of the aerosol-forming substrate. Alternatively, the one or more radially outer layers of heat-conductive material of the second heat-conducting element may extend beyond the aerosol-forming substrate in the downstream direction.

In other embodiments, the second heat-conducting element may comprise one or more radially outer layers of heat-conductive material that overlie only a rear portion of the aerosol-forming substrate.

Smoking articles according to the invention may comprise a blind combustible heat source or a non-blind combustible heat source.

As used herein, the term 'blind' is used to describe a combustible heat source wherein there are no airflow channels extending from the front face to the rear face of the combustible heat source.

In use, the air drawn through smoking articles according to the invention comprising a blind combustible heat source for inhalation by a user does not pass through any airflow channels along the blind combustible heat source. In smoking articles according to the invention comprising a blind combustible heat source, heating of the aerosol-forming substrate occurs primarily by conduction and heating of the aerosol-forming substrate by forced convection is minimised or reduced.

As used herein, the term 'airflow channel' is used to describe a channel extending along the length of a combustible heat source through which air may be drawn downstream for inhalation by a user.

As used herein, the term 'non-blind' is used to describe a combustible heat source wherein there are one or more airflow channels extending from the front face to the rear face of the combustible heat source.

In use, the air drawn through smoking articles according to the invention comprising a non-blind combustible heat source for inhalation by a user passes through one or more airflow channels along the non-blind combustible heat source. In smoking articles according to the invention comprising a non-blind combustible heat source, heating of the aerosol-forming substrate occurs by conduction and forced convection.

Where smoking articles according to the invention comprise a non-blind combustible heat source, the lack of any airflow channels through the blind combustible heat source advantageously substantially prevents or inhibits activation of combustion of the blind combustible heat source during puffing by a user.

Preventing or inhibiting activation of combustion of the combustible heat source during puffing by a user, advantageously substantially prevents or inhibits spikes in the temperature of the aerosol-forming substrate during puffing by a user. By preventing or inhibiting activation of combustion of the combustible heat source, and so preventing or inhibiting excess temperature increases in the aerosol-forming substrate, combustion or pyrolysis of the aerosol-forming substrate of smoking articles according to the invention under intense puffing regimes may be advantageously avoided. In addition, the impact of a user's puffing regime on the composition of the mainstream aerosol of smoking articles according to the invention may be advantageously minimised or reduced.

It is known to include additives in the combustible heat sources of heated smoking articles in order to improve the ignition and combustion properties of the combustible heat sources. However, the inclusion of ignition and combustion additives can give rise to decomposition and reaction products, which may disadvantageously enter air drawn through such known heated smoking articles during use thereof.

The inclusion of a blind combustible heat source may advantageously substantially prevent or inhibit combustion and decomposition products and other materials formed during ignition and combustion of the blind combustible heat source from entering air drawn through smoking articles according to the invention during use thereof. This is particularly advantageous where the blind combustible heat source comprises one or more additives to aid ignition or combustion of the blind combustible heat source.

In smoking articles according to the invention comprising a blind combustible heat source, it is particularly important to optimise the conductive heat transfer between the combustible heat source and the aerosol-forming substrate. The inclusion of a first heat-conducting element comprising one or more radially inner layers of heat-conductive material overlying a rear portion of the combustible heat source and a second heat-conducting element comprising one or more radially outer layers of heat-conductive material overlying at least a portion of the aerosol-forming substrate, wherein the one or more radially outer layers of heat-conductive material do not overlie the one or more radially inner layers of heat-conductive material, has been found to have a particularly advantageous effect on the smoking performance of smoking articles including blind heat sources, where there is little if any heating of the aerosol-forming substrate by forced convection.

It will be appreciated that smoking articles according to the invention may comprise blind combustible heat sources comprising one or more closed or blocked passageways through which air may not be drawn for inhalation by a user.

For example, smoking articles according to the invention may comprise blind combustible heat sources comprising one or more closed passageways that extend from the front face at the upstream end of the blind combustible heat source only part way along the length of the blind combustible heat source.

The inclusion of one or more closed air passageways increases the surface area of the blind combustible heat source that is exposed to oxygen from the air and may advantageously facilitate ignition and sustained combustion of the blind combustible heat source.

Alternatively, smoking articles according to the invention may comprise a non-blind combustible heat source wherein there are one or more airflow channels extending from the front face to the rear face of the non-blind combustible heat source.

The one or more airflow channels may comprise one or more enclosed airflow channels.

As used herein, the term 'enclosed' is used to describe airflow channels that extend through the interior of the non-blind combustible heat source and are surrounded by the non-blind combustible heat source.

Alternatively or in addition, the one or more airflow channels may comprise one or more non-enclosed airflow channels. For example, the one or more airflow channels may comprise one or more grooves or other non-enclosed airflow channels that extend along the exterior of the non-blind combustible heat source.

The one or more airflow channels may comprise one or more enclosed airflow channels or one or more non-enclosed airflow channels or a combination thereof.

In certain embodiments, smoking articles according to the invention comprise one, two or three airflow channels extending from the front face to the rear face of the non-blind combustible heat source.

In certain preferred embodiments, smoking articles according to the invention comprise a single airflow channel extending from the front face to the rear face of the non-blind combustible heat source.

In certain particularly preferred embodiments, smoking articles according to the invention comprise comprises a single substantially central or axial airflow channel extending from the front face to the rear face of the non-blind combustible heat source.

In such embodiments, the diameter of the single airflow channel is preferably between about 1.5 mm and about 3 mm.

It will be appreciated that in addition to one or more airflow channels through which air may be drawn for inhalation by a user, smoking articles according to the invention may comprise non-blind combustible heat sources comprising one or more closed or blocked passageways through which air may not be drawn for inhalation by a user.

For example, smoking articles according to the invention may comprise non-blind combustible heat sources comprising one or more airflow channels extending from the front face to the rear face of the combustible heat source and one or more closed passageways that extend from the front face of the non-blind combustible heat source only part way along the length combustible heat source.

The inclusion of one or more closed air passageways increases the surface area of the non-blind combustible heat source that is exposed to oxygen from the air and may advantageously facilitate ignition and sustained combustion of the non-blind combustible heat source.

Smoking articles according to the invention comprising a non-blind combustible heat source further comprise a non-combustible substantially air impermeable barrier between the non-blind combustible heat source and the one or more airflow channels extending from the front face to the rear face of the non-blind combustible heat source.

Where smoking articles according to the invention comprise a non-blind combustible heat source, inclusion of a non-combustible substantially air impermeable barrier between the non-blind combustible heat source and the one or more airflow channels extending from the front face to the rear face of the non-blind combustible heat source advantageously substantially prevents or inhibit activation of combustion of the non-blind combustible heat source during puffing by a user.

Preventing or inhibiting activation of combustion of the combustible heat source during puffing by a user, advantageously substantially prevents or inhibits spikes in the temperature of the aerosol-forming substrate during puffing by a user. By preventing or inhibiting activation of combustion of the combustible heat source, and so preventing or inhibiting excess temperature increases in the aerosol-forming substrate, combustion or pyrolysis of the aerosol-forming substrate of smoking articles according to the invention under intense puffing regimes may be advantageously avoided. In addition, the impact of a user's puffing regime on the composition of the mainstream aerosol of smoking articles according to the invention may be advantageously minimised or reduced.

Inclusion of a non-combustible substantially air impermeable barrier between the non-blind combustible heat source and the one or more airflow channels extending from the front face to the rear face of the non-blind combustible heat source may advantageously substantially prevent or inhibit combustion and decomposition products formed during ignition and combustion of the non-blind combustible heat source from entering air drawn into the smoking article through the one or more airflow channels as the drawn air passes through the one or more airflow channels. This is particularly advantageous where the non-blind combustible heat source comprises one or more additives to aid ignition or combustion of the non-blind combustible heat source.

The barrier between the non-blind combustible heat source and the one or more airflow channels may be adhered or otherwise affixed to the non-blind combustible heat source.

In certain preferred embodiments, the barrier comprises a non-combustible substantially air impermeable barrier coating provided on an inner surface of the one or more airflow channels. In such embodiments, preferably the barrier comprises a barrier coating provided on at least substantially the entire inner surface of the one or more airflow channels. More preferably, the barrier comprises a barrier coating provided on the entire inner surface of the one or more airflow channels.

As used herein, the term 'coating' is used to describe a layer of material that covers and is adhered to the combustible heat source.

In other embodiments, the barrier coating may be provided by insertion of a liner into the one or more airflow channels. For example, where the one or more airflow channels comprise one or more enclosed airflow channels that extend through the interior of the non-blind combustible heat source, a non-combustible substantially air impermeable hollow tube may be inserted into each of the one or more airflow channels.

Depending upon the desired characteristics and performance of the smoking article, the barrier may have a low thermal conductivity or a high thermal conductivity. Preferably, the barrier has a low thermal conductivity.

The thickness of the barrier may be appropriately adjusted to achieve good smoking performance. In certain embodiments, the barrier may have a thickness of between about 30 microns and about 200 microns. In a preferred embodiment, the barrier has a thickness of between about 30 microns and about 100 microns.

The barrier may be formed from one or more suitable materials that are substantially thermally stable and non-combustible at temperatures achieved by the non-blind combustible heat source during ignition and combustion. Suitable materials are known in the art and include, but are not limited to, for example: clays; metal oxides, such as iron oxide, alumina, titania, silica, silica-alumina, zirconia and ceria; zeolites; zirconium phosphate; and other ceramic materials or combinations thereof.

Preferred materials from which the barrier may be formed include clays, glasses, aluminium, iron oxide and combinations thereof. If desired, catalytic ingredients, such as ingredients that promote the oxidation of carbon monoxide to carbon dioxide, may be incorporated in the barrier. Suitable catalytic ingredients include, but are not limited to, for example, platinum, palladium, transition metals and their oxides.

Where the barrier comprises a barrier coating provided on an inner surface of the one or more airflow channels, the barrier coating may be applied to the inner surface of the one or more airflow channels by any suitable method, such as the methods described in U.S. Pat. No. 5,040,551. For example, the inner surface of the one or more airflow channels may be sprayed, wetted or painted with a solution or a suspension of the barrier coating. In certain preferred embodiments, the barrier coating is applied to the inner surface of the one or more airflow channels by the process described in WO-A2-2009/074870 as the combustible heat source is extruded.

Smoking articles according to the invention may further comprise a non-combustible substantially air impermeable barrier between the rear face of the combustible heat source and the aerosol-forming substrate.

Where smoking articles according to the invention comprise a non-blind combustible heat source and a non-combustible, substantially air impermeable barrier between the rear face of the combustible heat source and the aerosol-forming substrate, the barrier should allow air entering the smoking article through the one or more airflow channels extending from the front face to the rear face of the non-blind combustible heat source to be drawn downstream through the smoking article.

The barrier may abut one or both of the rear face of the combustible heat source and the aerosol-forming substrate. Alternatively, the barrier may be spaced apart from one or both of the rear face of the combustible heat source and the aerosol-forming substrate.

The barrier may be adhered or otherwise affixed to one or both of the rear face of the combustible heat source and the aerosol-forming substrate.

In certain preferred embodiments, the barrier comprises a non-combustible substantially air impermeable barrier coating provided on the rear face of the combustible heat source. In such embodiments, preferably the barrier comprises barrier coating provided on at least substantially the entire rear face of the combustible heat source. More preferably, the barrier comprises a barrier coating provided on the entire rear face of the combustible heat source.

The barrier may advantageously limit the temperature to which the aerosol-forming substrate is exposed during ignition and combustion of the combustible heat source, and so help to avoid or reduce thermal degradation or combustion of the aerosol-forming substrate during use of the smoking article. This is particularly advantageous where the combustible heat source comprises one or more additives to aid ignition of the combustible heat source.

To facilitate aerosol formation, the aerosol-forming substrates of heated smoking articles typically comprise a polyhydric alcohol, such as glycerine, or other known aerosol-formers. During storage and smoking, such aerosol-formers may migrate from the aerosol-forming substrates of known heated smoking articles to the combustible heat sources thereof. Migration of aerosol-formers to the combustible heat sources of known heated smoking articles can disadvantageously lead to decomposition of the aerosol-formers, particularly during smoking of the heated smoking articles.

Inclusion of a non-combustible substantially air impermeable barrier between the rear face of the combustible heat source and the aerosol-forming substrate of smoking articles according to the invention may advantageously substantially prevent or inhibit migration of components of the aerosol-forming substrate to the combustible heat source during storage of the smoking article.

Alternatively or in addition, inclusion of a non-combustible substantially air impermeable barrier between the rear face of the combustible heat source and the aerosol-forming substrate of smoking articles according to the invention may advantageously substantially prevent or inhibit migration of components of the aerosol-forming substrate to the combustible heat source during use of the smoking article.

Inclusion of a non-combustible substantially air impermeable barrier between the rear face of the combustible heat source and the aerosol-forming substrate is particularly advantageous where the aerosol-forming substrate comprises at least one aerosol-former.

In such embodiments, inclusion of a non-combustible substantially air impermeable barrier between the rear face of the combustible heat source and the aerosol-forming substrate of smoking articles according to the invention may advantageously prevent or inhibit migration of the at least one aerosol-former from the aerosol-forming substrate to the combustible heat source during storage and use of the smoking article. Decomposition of the at least one aerosol-former during use of the smoking article may thus be advantageously substantially avoided or reduced.

Depending upon the desired characteristics and performance of the smoking article, the non-combustible substantially air impermeable barrier between the rear face of the combustible heat source and the aerosol-forming substrate may have a low thermal conductivity or a high thermal conductivity. In certain embodiments, the barrier may be formed from material having a bulk thermal conductivity of between about 0.1 W per meter Kelvin (W/(m·K)) and about 200 W per meter Kelvin (W/(m·K)), at 23° C. and a relative humidity of 50% as measured using the modified transient plane source (MTPS) method.

The thickness of the barrier may be appropriately adjusted to achieve good smoking performance. In certain embodiments, the barrier may have a thickness of between about 10 microns and about 500 microns.

The barrier may be formed from one or more suitable materials that are substantially thermally stable and non-combustible at temperatures achieved by the combustible heat source during ignition and combustion. Suitable materials are known in the art and include, but are not limited to, clays (such as, for example, bentonite and kaolinite), glasses, minerals, ceramic materials, resins, metals and combinations thereof.

Preferred materials from which the barrier may be formed include clays and glasses. More preferred materials from which the barrier may be formed include copper, aluminium, stainless steel, alloys, alumina ($Al_2O_3$), resins, and mineral glues.

In certain preferred embodiments, the barrier comprises a clay coating comprising a 50/50 mixture of bentonite and kaolinite provided on the rear face of the combustible heat source. In other preferred embodiments, the barrier comprises a glass coating, more preferably a sintered glass coating, provided on the rear face of the combustible heat source.

In certain particularly preferred embodiments, the barrier comprises an aluminium coating provided on the rear face of the combustible heat source.

Preferably, the barrier has a thickness of at least about 10 microns.

Due to the slight permeability of clays to air, in embodiments where the barrier comprises a clay coating provided on the rear face of the combustible heat source, the clay coating more preferably has a thickness of at least about 50 microns, and most preferably of between about 50 microns and about 350 microns.

In embodiments where the barrier is formed from one or more materials that are more impervious to air, such as aluminium, the barrier may be thinner, and generally will preferably have a thickness of less than about 100 microns, and more preferably of about 20 microns.

In embodiments where the barrier comprises a glass coating provided on the rear face of the combustible heat source, the glass coating preferably has a thickness of less than about 200 microns.

The thickness of the barrier may be measured using a microscope, a scanning electron microscope (SEM) or any other suitable measurement methods known in the art.

Where the barrier comprises a barrier coating provided on the rear face of the combustible heat source, the barrier coating may be applied to cover and adhere to the rear face of the combustible heat source by any suitable methods known in the art including, but not limited to, spray-coating, vapour deposition, dipping, material transfer (for example, brushing or gluing), electrostatic deposition or any combination thereof.

For example, the barrier coating may be made by pre-forming a barrier in the approximate size and shape of the rear face of the combustible heat source, and applying it to the rear face of the combustible heat source to cover and adhere to at least substantially the entire rear face of the combustible heat source. Alternatively, the barrier coating may be cut or otherwise machined after it is applied to the rear face of the combustible heat source. In one preferred embodiment, aluminium foil is applied to the rear face of the combustible heat source by gluing or pressing it to the combustible heat source, and is cut or otherwise machined so that the aluminium foil covers and adheres to at least substantially the entire rear face of the combustible heat source, preferably to the entire rear face of the combustible heat source.

In another preferred embodiment, the barrier coating is formed by applying a solution or suspension of one or more suitable coating materials to the rear face of the combustible heat source. For example, the barrier coating may be applied to the rear face of the combustible heat source by dipping the rear face of the combustible heat source in a solution or suspension of one or more suitable coating materials or by brushing or spray-coating a solution or suspension or electrostatically depositing a powder or powder mixture of one or more suitable coating materials onto the rear face of the combustible heat source. Where the barrier coating is applied to the rear face of the combustible heat source by electrostatically depositing a powder or powder mixture of one or more suitable coating materials onto the rear face of the combustible heat source, the rear face of the combustible heat source is preferably pre-treated with water glass before electrostatic deposition. Preferably, the barrier coating is applied by spray-coating.

The barrier coating may be formed through a single application of a solution or suspension of one or more suitable coating materials to the rear face of the combustible heat source. Alternatively, the barrier coating may be formed through multiple applications of a solution or suspension of one or more suitable coating materials to the rear face of the combustible heat source. For example, the barrier coating may be formed through one, two, three, four, five, six, seven or eight successive applications of a solution or suspension of one or more suitable coating materials to the rear face of the combustible heat source.

Preferably, the barrier coating is formed through between one and ten applications of a solution or suspension of one or more suitable coating materials to the rear face of the combustible heat source.

After application of the solution or suspension of one or more coating materials to the rear face thereof, the combustible heat source may be dried to form the barrier coating.

Where the barrier coating is formed through multiple applications of a solution or suspension of one or more suitable coating materials to the rear face thereof, the combustible heat source may need to be dried between successive applications of the solution or suspension.

Alternatively or in addition to drying, after application of a solution or suspension of one or more coating materials to the rear face of the combustible heat source, the coating material on the combustible heat source may be sintered in order to form the barrier coating. Sintering of the barrier coating is particularly preferred where the barrier coating is a glass or ceramic coating. Preferably, the barrier coating is sintered at a temperature of between about 500° C. and about 900° C., and more preferably at about 700° C.

Smoking articles according to the invention may comprise one or more first air inlets around the periphery of the aerosol-forming substrate.

As used herein, the term 'air inlet' is used to describe a hole, slit, slot or other aperture through which air may be drawn into the smoking article.

Where smoking articles according to the invention comprise one or more first air inlets around the periphery of the aerosol-forming substrate, in use, cool air is drawn into the aerosol-forming substrate of the smoking article through the first air inlets. The air drawn into the aerosol-forming substrate through the first air inlets passes downstream through the smoking article from the aerosol-forming substrate and exits the smoking article through the proximal end thereof.

During puffing by a user, the cool air drawn through the one or more first air inlets around the periphery of the aerosol-forming substrate advantageously reduces the temperature of the aerosol-forming substrate. This advantageously substantially prevents or inhibits spikes in the temperature of the aerosol-forming substrate during puffing by a user.

As used herein, the term 'cool air' is used to describe ambient air that is not significantly heated by the combustible heat source upon puffing by a user.

By preventing or inhibiting spikes in the temperature of the aerosol-forming substrate, the inclusion of one or more first air inlets around the periphery of the aerosol-forming substrate, advantageously helps to avoid or reduce combustion or pyrolysis of the aerosol-forming substrate under intense puffing regimes. In addition, the inclusion of one or more first air inlets around the periphery of the aerosol-forming substrate advantageously helps to minimise or reduce the impact of a user's puffing regime on the composition of the mainstream aerosol of the smoking article.

In certain preferred embodiments, the one or more first air inlets are located proximate to the downstream end of the aerosol-forming substrate.

In certain embodiments, the aerosol-forming substrate may abut the rear face of the combustible heat source or a non-combustible substantially air impermeable barrier coating provided on the rear face of the combustible heat source.

As used herein, the term 'abut' is used to describe the aerosol-forming substrate being in direct contact with the rear face of the combustible heat source or a non-combustible substantially air impermeable barrier coating provided on the rear face of the combustible heat source.

In other embodiments, the aerosol-forming substrate may be spaced apart from the rear face of the combustible heat source. That is, there may be a space or gap between the aerosol-forming substrate and the rear face of the combustible heat source.

As used herein, the term 'spaced apart' is used to describe the aerosol-forming substrate not being in direct contact with the rear face of the combustible heat source or a non-combustible substantially air impermeable barrier coating provided on the rear face of the combustible heat source.

Alternatively or in addition to one or more first air inlets, in such embodiments smoking articles according to the invention may comprise one or more second air inlets between the rear face of the combustible heat source and the aerosol-forming substrate. In use, cool air is drawn into the space between the combustible heat source and the aerosol-forming substrate through the second air inlets. The air drawn into the space between the combustible heat source and the aerosol-forming substrate through the second air inlets passes downstream through the smoking article from the space between the combustible heat source and the aerosol-forming substrate and exits the smoking article through the proximal end thereof.

During puffing by a user, cool air drawn through the one or more second inlets between the rear face of the combustible heat source and the aerosol-forming substrate may advantageously reduce the temperature of the aerosol-forming substrate. This may advantageously substantially prevent or inhibit spikes in the temperature of the aerosol-forming substrate during puffing by a user.

Alternatively or in addition to one or more first air inlets or one or more second air inlets, smoking articles according to the invention may comprise one or more third air inlets downstream of the aerosol-forming substrate.

It will be appreciated that smoking articles according to the invention may comprise one or more first air inlets around the periphery of the aerosol-forming substrate, or one or more second air inlets between the rear face of the combustible heat source and the aerosol-forming substrate, or one or more third air inlets downstream of the aerosol-forming substrate, or any combination thereof.

The number, shape, size and location of the air inlets may be appropriately adjusted to achieve a good smoking performance.

In certain embodiments comprising one or more third air inlets, preferably smoking articles according to the invention comprise an airflow directing element downstream of the aerosol-forming substrate. The airflow directing element defines an airflow pathway through the smoking article. The one or more third air inlets are preferably provided between a downstream end of the aerosol-forming substrate and a downstream end of the airflow directing element.

In use, air is drawn into the airflow directing element through the one or more third air-inlet. At least a portion of the drawn air flows upstream along a first portion of the airflow pathway, towards the aerosol-forming substrate. The air flows through the aerosol-forming substrate, and then downstream along a second portion of the airflow pathway towards the mouth end of the smoking article.

The airflow directing element may comprise an open-ended, substantially air impermeable hollow body. In such embodiments, the air drawn in through the one or more third air inlets is first drawn upstream preferably along an exterior portion of the open-ended, substantially air impermeable hollow body and then downstream preferably through the interior of the open-ended, substantially air impermeable hollow body.

The substantially air impermeable hollow body may be formed from one or more suitable air impermeable materials that are substantially thermally stable at the temperature of the aerosol generated by the transfer of heat from the heat source to the aerosol-forming substrate. Suitable materials are known in the art and include, but are not limited to, cardboard, plastic, ceramic and combinations thereof.

In one preferred embodiment, the open-ended, substantially air impermeable hollow body is a cylinder, preferably a right circular cylinder.

In another preferred embodiment, the open-ended, substantially air impermeable hollow body is a truncated cone, preferably a truncated right circular cone.

The open-ended, substantially air impermeable hollow body may have a length of between about 7 mm and about 50 mm, for example a length of between about 10 mm and about 45 mm or between about 15 mm and about 30 mm. The airflow directing element may have other lengths depending upon the desired overall length of the smoking article, and the presence and length of other components within the smoking article.

Where the open-ended, substantially air impermeable hollow body is a cylinder, the cylinder may have a diameter of between about 2 mm and about 5 mm, for example a diameter of between about 2.5 mm and about 4.5 mm. The cylinder may have other diameters depending on the desired overall diameter of the smoking article.

Where the open-ended, substantially air impermeable hollow body is a truncated cone, the upstream end of the truncated cone may have a diameter of between about 2 mm and about 5 mm, for example a diameter of between about 2.5 mm and about 4.5 mm. The upstream end of the truncated cone may have other diameters depending on the desired overall diameter of the smoking article.

Where the open-ended, substantially air impermeable hollow body is a truncated cone, the downstream end of the truncated cone may have a diameter of between about 5 mm and about 9 mm, for example of between about 7 mm and about 8 mm. The downstream end of the truncated cone may have other diameters depending on the desired overall diameter of the smoking article. Preferably, the downstream end of the truncated cone is of substantially the same diameter as the aerosol-forming substrate.

The open-ended, substantially air impermeable hollow body may abut the aerosol-forming substrate. Alternatively, the open-ended, substantially air impermeable hollow body may extend into the aerosol-forming substrate. For example, in certain embodiments the open-ended, substantially air impermeable hollow body may extend a distance of up to 0.5 L into the aerosol-forming substrate, where L is the length of the aerosol-forming substrate.

The upstream end of the substantially air impermeable hollow body is of reduced diameter compared to the aerosol-forming substrate.

In certain embodiments, the downstream end of the substantially air impermeable hollow body is of reduced diameter compared to the aerosol-forming substrate.

In other embodiments, the downstream end of the substantially air impermeable hollow body is of substantially the same diameter as the aerosol-forming substrate.

Where the downstream end of the substantially air impermeable hollow body is of reduced diameter compared to the aerosol-forming substrate, the substantially air impermeable hollow body may be circumscribed by a substantially air impermeable seal. In such embodiments, the substantially air impermeable seal is located downstream of the one or more third air inlets. The substantially air impermeable seal may be of substantially the same diameter as the aerosol-forming substrate. For example, in some embodiments the downstream end of the substantially air impermeable hollow body may be circumscribed by a substantially impermeable plug or washer of substantially the same diameter as the aerosol-forming substrate.

The substantially air impermeable seal may be formed from one or more suitable air impermeable materials that are substantially thermally stable at the temperature of the aerosol generated by the transfer of heat from the combustible heat source to the aerosol-forming substrate. Suitable materials are known in the art and include, but are not limited to, cardboard, plastic, wax, silicone, ceramic and combinations thereof.

At least a portion of the length of the open-ended, substantially air impermeable hollow body may be circumscribed by an air permeable diffuser. The air permeable diffuser may be of substantially the same diameter as the aerosol-forming substrate. The air permeable diffuser may be formed from one or more suitable air permeable materials that are substantially thermally stable at the temperature of the aerosol generated by the transfer of heat from the combustible heat source to the aerosol-forming substrate. Suitable air permeable materials are known in the art and include, but are not limited to, porous materials such as, for example, cellulose acetate tow, cotton, open-cell ceramic and polymer foams, tobacco material and combinations thereof.

In one preferred embodiment, the airflow directing element comprises an open ended, substantially air impermeable, hollow tube of reduced diameter compared to the aerosol-forming substrate and an annular, substantially air impermeable seal of substantially the same outer diameter as the aerosol-forming substrate, which circumscribes a downstream end of the hollow tube.

The airflow directing element may further comprise an inner wrapper, which circumscribes the hollow tube and the annular substantially air impermeable seal.

The open upstream end of the hollow tube may abut a downstream end of the aerosol-forming substrate. Alternatively, the open upstream end of the hollow tube may be inserted or otherwise extend into the downstream end of the aerosol-forming substrate.

The airflow directing element may further comprise an annular air permeable diffuser of substantially the same outer diameter as the aerosol-forming substrate, which circumscribes at least a portion of the length of the hollow tube upstream of the annular substantially air impermeable seal. For example, the hollow tube may be at least partially embedded in a plug of cellulose acetate tow.

In another preferred embodiment, the airflow directing element comprises: an open ended, substantially air impermeable, truncated hollow cone having an upstream end of reduced diameter compared to the aerosol-forming substrate and a downstream end of substantially the same diameter as the aerosol-forming substrate.

The open upstream end of the truncated hollow cone may abut a downstream end of the aerosol-forming substrate. Alternatively, the open upstream end of the truncated hollow cone may be inserted or otherwise extend into the downstream end of the aerosol-forming substrate.

The airflow directing element may further comprise an annular air permeable diffuser of substantially the same outer diameter as the aerosol-forming substrate, which circumscribes at least a portion of the length of the truncated hollow cone. For example, the truncated hollow cone may be at least partially embedded in a plug of cellulose acetate tow.

In another preferred embodiment, the airflow directing element comprises an air-permeable segment downstream of the aerosol-forming substrate, the airflow directing element defining an airflow pathway; and the smoking article comprises one or more third air inlets for drawing air into the air-permeable segment, wherein the airflow pathway comprises a first portion and a second portion, the first portion of the airflow pathway extending from the one or more third air inlets towards the aerosol-forming substrate, and the second portion of the airflow pathway extending from the aerosol-forming substrate towards the mouth end of the smoking article, wherein the first portion of the airflow pathway is defined by a low resistance-to-draw portion of the air-permeable segment that extends from proximate to the one or more third air inlets to an upstream end of the air-permeable segment, and the air-permeable segment further comprises a high resistance-to-draw portion that extends from proximate to the one or more third air inlets to a downstream end of the air-permeable segment.

As used herein, the term 'air permeable segment' refers to a segment that is not blocked, plugged or sealed in a way to completely block air from passing through the air permeable segment.

The ratio of the resistance-to-draw between the high resistance-to-draw portion and the low resistance-to-draw portion is higher than 1:1 and lower than about 50:1. Preferably, the second portion of the airflow pathway is defined by a substantially hollow tube.

The resistance-to-draw is measured in accordance with ISO 6565:2011 and is typically expressed in units of $mmH_2O$. The resistance-to-draw of the air permeable segment may be measured by drawing on one end of the airflow directing element while the second portion of the airflow pathway is sealed such that air flows only through the air permeable segment of the airflow directing element. Preferably, the resistance-to-draw of the air permeable segment is homogenous along the length of the segment. In such embodiments, the resistance-to-draw of the low resistance-to-draw portion and high resistance-to-draw portion, respectively, will be proportional to their respective length in the air permeable segment. In a preferred embodiment, the one or more third air inlets are located towards the upstream end of the airflow directing element. In this way, the resistance-to-draw of the portion of the air permeable segment upstream of the one or more third air inlets should be lower than the resistance-to-draw of the portion of the air permeable segment downstream of the one or more third air inlets.

In other embodiments where the resistance-to-draw of the air-permeable segment is not homogeneous along the length of the segment, the resistance-to-draw of the low resistance-to-draw portion of the air permeable segment may be measured by transversely cutting the airflow directing element at a location corresponding to the one or more third air inlets closest to the upstream end of the air permeable segment to separate the low resistance-to-draw portion of the air permeable segment from the remainder of the air permeable segment, and drawing on one end of the cut low resistance-to-draw portion while sealing the second portion of the air flow pathway such that air flows only through the low resistance-to-draw portion of the air permeable segment. Similarly, the resistance-to-draw of the high resistance-to-draw portion of the air permeable segment may be measured by transversely cutting the airflow directing element at a location corresponding to the one or more third air inlets closest to the downstream end of the air permeable segment to separate the high resistance-to-draw portion of the air permeable segment from the remainder of the air permeable segment, and drawing on one end of the cut high resistance-to-draw portion while sealing the second portion of the air flow pathway such that air flows only through the high resistance-to-draw portion of the air permeable segment.

Preferably, the combustible heat source is a carbonaceous heat source. As used herein, the term 'carbonaceous' is used to describe a combustible heat source comprising carbon. Preferably, combustible carbonaceous heat sources for use in smoking articles according to the invention have a carbon content of at least about 35 percent, more preferably of at least about 40 percent, most preferably of at least about 45 percent by dry weight of the combustible heat source.

In some embodiments, combustible heat sources according to the invention are combustible carbon-based heat sources. As used herein, the term 'carbon-based heat source' is used to describe a heat source comprised primarily of carbon.

Combustible carbon-based heat sources for use in smoking articles according to the invention have a carbon content of at least about 50 percent. For example, combustible carbon-based heat sources for use in smoking articles according to the invention may have a carbon content of at least about 60 percent, or at least about 70 percent, or at least about 80 percent by dry weight of the combustible carbon-based heat source.

Smoking articles according to the invention may comprise combustible carbonaceous heat sources formed from one or more suitable carbon-containing materials.

If desired, one or more binders may be combined with the one or more carbon-containing materials. Preferably, the one or more binders are organic binders. Suitable known organic binders, include but are not limited to, gums (for example, guar gum), modified celluloses and cellulose derivatives (for example, methyl cellulose, carboxymethyl cellulose, hydroxypropyl cellulose and hydroxypropyl methylcellulose) flour, starches, sugars, vegetable oils and combinations thereof.

In one preferred embodiment, the combustible heat source is formed from a mixture of carbon powder, modified cellulose, flour and sugar.

Instead of, or in addition to one or more binders, combustible heat sources for use in smoking articles according to the invention may comprise one or more additives in order to improve the properties of the combustible heat source. Suitable additives include, but are not limited to, additives to promote consolidation of the combustible heat source (for example, sintering aids), additives to promote ignition of the combustible heat source (for example, oxidisers such as perchlorates, chlorates, nitrates, peroxides, permanganates, zirconium and combinations thereof), additives to promote combustion of the combustible heat source (for example, potassium and potassium salts, such as potassium citrate) and additives to promote decomposition of one or more gases produced by combustion of the combustible heat source (for example catalysts, such as CuO, $Fe_2O_3$ and $Al_2O_3$).

Where smoking articles according to the invention comprise a barrier coating provided on the rear face of the combustible heat source, such additives may be incorporated in the combustible heat source prior to or after application of the barrier coating to the rear face of the combustible heat source.

In certain preferred embodiments, the combustible heat source is a combustible carbonaceous heat source comprising carbon and at least one ignition aid. In one preferred embodiment, the combustible heat source is a combustible carbonaceous heat source comprising carbon and at least one ignition aid as described in WO-A1-2012/164077.

As used herein, the term 'ignition aid' is used to denote a material that releases one or both of energy and oxygen during ignition of the combustible heat source, where the rate of release of one or both of energy and oxygen by the material is not ambient oxygen diffusion limited. In other words, the rate of release of one or both of energy and oxygen by the material during ignition of the combustible heat source is largely independent of the rate at which ambient oxygen can reach the material. As used herein, the term 'ignition aid' is also used to denote an elemental metal that releases energy during ignition of the combustible heat source, wherein the ignition temperature of the elemental metal is below about 500° C. and the heat of combustion of the elemental metal is at least about 5 kJ/g.

As used herein, the term 'ignition aid' does not include alkali metal salts of carboxylic acids (such as alkali metal citrate salts, alkali metal acetate salts and alkali metal succinate salts), alkali metal halide salts (such as alkali metal chloride salts), alkali metal carbonate salts or alkali metal phosphate salts, which are believed to modify carbon combustion. Even when present in a large amount relative to the total weight of the combustible heat source, such alkali metal burn salts do not release enough energy during ignition of a combustible heat source to produce an acceptable aerosol during early puffs.

Examples of suitable oxidizing agents include, but are not limited to: nitrates such as, for example, potassium nitrate, calcium nitrate, strontium nitrate, sodium nitrate, barium nitrate, lithium nitrate, aluminium nitrate and iron nitrate; nitrites; other organic and inorganic nitro compounds; chlorates such as, for example, sodium chlorate and potassium chlorate; perchlorates such as, for example, sodium perchlorate; chlorites; bromates such as, for example, sodium bromate and potassium bromate; perbromates; bromites; borates such as, for example, sodium borate and potassium borate; ferrates such as, for example, barium ferrate; ferrites; manganates such as, for example, potassium manganate; permanganates such as, for example, potassium permanganate; organic peroxides such as, for example, benzoyl peroxide and acetone peroxide; inorganic peroxides such as, for example, hydrogen peroxide, strontium peroxide, magnesium peroxide, calcium peroxide, barium peroxide, zinc peroxide and lithium peroxide; superoxides such as, for example, potassium superoxide and sodium superoxide; iodates; periodates; iodites; sulphates; sulfites; other sulfoxides; phosphates; phospinates; phosphites; and phosphanites.

While advantageously improving the ignition and combustion properties of the combustible heat source, the inclusion of ignition and combustion additives can give rise to undesirable decomposition and reaction products during use of the smoking article. For example, decomposition of nitrates included in the combustible heat source to aid ignition thereof can result in the formation of nitrogen oxides.

Where smoking articles according to the invention comprise a non-blind combustible heat source, the inclusion of a non-combustible substantially air impermeable barrier between the one or more airflow channels and the non-blind combustible heat source may advantageously substantially prevent or inhibit such decomposition and reaction products from entering air drawn into smoking articles according to the invention through the one or more airflow channels as the drawn air passes through the one or more airflow channels.

The inclusion of a non-combustible substantially air impermeable barrier between the rear face of the combustible heat source and the aerosol-forming substrate may also advantageously substantially prevent or inhibit such decomposition and reaction products from entering air drawn through smoking articles according to the invention.

Combustible carbonaceous heat sources for use in smoking articles according to the invention may be prepared as described in prior art that is known to persons of ordinary skill in the art.

Combustible carbonaceous heat sources for use in smoking articles according to the invention, are preferably formed by mixing one or more carbon-containing materials with one or more binders and other additives, where included, and pre-forming the mixture into a desired shape. The mixture of one or more carbon containing materials, one or more binders and optional other additives may be pre-formed into a desired shape using any suitable known ceramic forming methods such as, for example, slip casting, extrusion, injection moulding and die compaction or pressing. In certain preferred embodiments, the mixture is pre-formed into a desired shape by pressing or extrusion or a combination thereof.

Preferably, the mixture of one or more carbon-containing materials, one or more binders and other additives is pre-formed into an elongate rod. However, it will be appreciated that the mixture of one or more carbon-containing materials, one or more binders and other additives may be pre-formed into other desired shapes.

After formation, particularly after extrusion, the elongate rod or other desired shape is preferably dried to reduce its moisture content and then pyrolysed in a non-oxidizing atmosphere at a temperature sufficient to carbonise the one or more binders, where present, and substantially eliminate any volatiles in the elongate rod or other shape. The elongate rod or other desired shape is pyrolysed preferably in a nitrogen atmosphere at a temperature of between about 700° C. and about 900° C.

In certain embodiments, at least one metal nitrate salt is incorporated in the combustible heat source by including at least one metal nitrate precursor in the mixture of one or more carbon containing materials, one or more binders and other additives. The at least one metal nitrate precursor is then subsequently converted in-situ into at least one metal nitrate salt by treating the pyrolysed pre-formed cylindrical rod or other shape with an aqueous solution of nitric acid. In one embodiment, the combustible heat source comprises at least one metal nitrate salt having a thermal decomposition temperature of less than about 600° C., more preferably of less than about 400° C. Preferably, the at least one metal nitrate salt has a decomposition temperature of between about 150° C. and about 600° C., more preferably of between about 200° C. and about 400° C.

In preferred embodiments, exposure of the combustible heat source to a conventional yellow flame lighter or other ignition means should cause the at least one metal nitrate salt to decompose and release oxygen and energy. This decomposition causes an initial boost in the temperature of the combustible heat source and also aids in the ignition of the combustible heat source. After decomposition of the at least one metal nitrate salt, the combustible heat source preferably continues to combust at a lower temperature.

The inclusion of at least one metal nitrate salt advantageously results in ignition of the combustible heat source being initiated internally, and not only at a point on the surface thereof. Preferably, the at least one metal nitrate salt is present in the combustible heat source in an amount of between about 20 percent by dry weight and about 50 percent by dry weight of the combustible heat source.

In other embodiments, the combustible heat source comprises at least one peroxide or superoxide that actively evolves oxygen at a temperature of less than about 600° C., more preferably at a temperature of less than about 400° C.

Preferably, the at least one peroxide or superoxide actively evolves oxygen at a temperature of between about 150° C. and about 600° C., more preferably at a temperature of between about 200° C. and about 400° C., most preferably at a temperature of about 350° C.

In use, exposure of the combustible heat source to a conventional yellow flame lighter or other ignition means should cause the at least one peroxide or superoxide to decompose and release oxygen. This causes an initial boost in the temperature of the combustible heat source and also aids in the ignition of the combustible heat source. After decomposition of the at least one peroxide or superoxide, the combustible heat source preferably continues to combust at a lower temperature.

The inclusion of at least one peroxide or superoxide advantageously results in ignition of the combustible heat source being initiated internally, and not only at a point on the surface thereof.

The combustible heat source preferably has a porosity of between about 20 percent and about 80 percent, more preferably of between about 20 percent and 60 percent. Where the combustible heat source comprises at least one metal nitrate salt, this advantageously allows oxygen to diffuse into the mass of the combustible heat source at a rate sufficient to sustain combustion as the at least one metal nitrate salt decomposes and combustion proceeds. Even more preferably, the combustible heat source has a porosity of between about 50 percent and about 70 percent, more preferably of between about 50 percent and about 60 percent as measured by, for example, mercury porosimetry or helium pycnometry. The required porosity may be readily achieved during production of the combustible heat source using conventional methods and technology.

Advantageously, combustible carbonaceous heat sources for use in smoking articles according to the invention have an apparent density of between about 0.6 g/cm$^3$ and about 1 g/cm$^3$.

Preferably, the combustible heat source has a mass of between about 300 mg and about 500 mg, more preferably of between about 400 mg and about 450 mg.

Preferably, the combustible heat source has a length of between about 7 mm and about 17 mm, more preferably of between about 7 mm and about 15 mm, most preferably of between about 7 mm and about 13 mm.

Preferably, the combustible heat source has a diameter of between about 5 mm and about 9 mm, more preferably of between about 7 mm and about 8 mm.

Preferably, the combustible heat source is of substantially uniform diameter. However, the combustible heat source may alternatively be tapered so that the diameter of a rear portion of the blind combustible heat source is greater than the diameter of a front portion thereof. Particularly preferred are combustible heat sources that are substantially cylindrical. The combustible heat source may, for example, be a cylinder or tapered cylinder of substantially circular cross-section or a cylinder or tapered cylinder of substantially elliptical cross-section.

Smoking articles according to the invention preferably comprise an aerosol-forming substrate comprising at least one aerosol-former and a material capable of releasing volatile compounds in response to heating. The aerosol-forming substrate may comprise other additives and ingredients including, but not limited to, humectants, flavourants, binders and mixtures thereof.

Preferably, the aerosol-forming substrate comprises nicotine. More preferably, the aerosol-forming substrate comprises tobacco.

The at least one aerosol-former may be any suitable known compound or mixture of compounds that, in use, facilitates formation of a dense and stable aerosol and that is substantially resistant to thermal degradation at the operating temperature of the smoking article. Suitable aerosol-formers are well known in the art and include, for example, polyhydric alcohols, esters of polyhydric alcohols, such as glycerol mono-, di- or triacetate, and aliphatic esters of mono-, di- or polycarboxylic acids, such as dimethyl dodecanedioate and dimethyl tetradecanedioate. Preferred aerosol formers for use in smoking articles according to the invention are polyhydric alcohols or mixtures thereof, such as triethylene glycol, 1,3-butanediol and, most preferred, glycerine.

The material capable of emitting volatile compounds in response to heating may be a charge of plant-based material. The material capable of emitting volatile compounds in response to heating may be a charge of homogenised plant-based material. For example, the aerosol-forming substrate may comprise one or more materials derived from plants including, but not limited to: tobacco; tea, for example green tea; peppermint; laurel; eucalyptus; basil; sage; verbena; and tarragon.

Preferably, the material capable of emitting volatile compounds in response to heating is a charge of tobacco-based material, most preferably a charge of homogenised tobacco-based material.

The aerosol-forming substrate may be in the form of a plug or segment comprising a material capable of emitting volatile compounds in response to heating circumscribed by a paper or other wrapper. As stated above, where an aerosol-forming substrate is in the form of such a plug or segment, the entire plug or segment including any wrapper is considered to be the aerosol-forming substrate.

Preferably, the aerosol-forming substrate has a length of between about 5 mm and about 20 mm, more preferably of between about 8 mm and about 12 mm.

In preferred embodiments, the aerosol-forming substrate comprises a plug of tobacco-based material wrapped in a plug wrap. In particular preferred embodiments, the aerosol-forming substrate comprises a plug of homogenised tobacco-based material wrapped in a plug wrap.

Smoking articles according to the invention preferably comprise a mouthpiece downstream of the aerosol-forming substrate and, where present, downstream of the airflow directing element. The mouthpiece is located at the proximal end of the smoking article.

Preferably, the mouthpiece is of low filtration efficiency, more preferably of very low filtration efficiency. The mouthpiece may be a single segment or component mouthpiece. Alternatively, the mouthpiece may be a multi-segment or multi-component mouthpiece.

The mouthpiece may comprise a filter comprising one or more segments comprising suitable known filtration materials. Suitable filtration materials are known in the art and include, but are not limited to, cellulose acetate and paper. Alternatively or in addition, the mouthpiece may comprise one or more segments comprising absorbents, adsorbents, flavourants, and other aerosol modifiers and additives or combinations thereof.

Smoking articles according to the element preferably further comprise a transfer element or spacer element between the aerosol-forming substrate and the mouthpiece. Where present, the airflow directing element is preferably upstream of the transfer element. In such embodiments, the transfer element may be spaced apart from one or both of the airflow directing element and the mouthpiece.

The transfer element may abut one or both of the aerosol-forming substrate and the mouthpiece. Alternatively, the transfer element may be spaced apart from one or both of the aerosol-forming substrate and the mouthpiece.

The inclusion of a transfer element advantageously allows cooling of the aerosol generated by heat transfer from the combustible heat source to the aerosol-forming substrate. The inclusion of a transfer element also advantageously allows the overall length of smoking articles according to the invention to be adjusted to a desired value, for example to a length similar to that of conventional cigarettes, through an appropriate choice of the length of the transfer element.

The transfer element may have a length of between about 7 mm and about 50 mm, for example a length of between about 10 mm and about 45 mm or of between about 15 mm and about 30 mm. The transfer element may have other lengths depending upon the desired overall length of the smoking article, and the presence and length of other components within the smoking article.

Preferably, the transfer element comprises at least one open-ended tubular hollow body. In such embodiments, in use, the air drawn through the smoking article passes through the at least one open-ended tubular hollow body as it passes downstream through the smoking article from the aerosol-forming substrate to the proximal end thereof.

The transfer element may comprise at least one open-ended tubular hollow bodies formed from one or more suitable materials that are substantially thermally stable at the temperature of the aerosol generated by the transfer of heat from the combustible heat source to the aerosol-forming substrate. Suitable materials are known in the art and include, but are not limited to, paper, cardboard, plastics, such a cellulose acetate, ceramics and combinations thereof.

Alternatively or in addition, smoking articles according to the invention may comprise an aerosol-cooling element or heat exchanger between the aerosol-forming substrate and the mouthpiece. The aerosol-cooling element may comprise a plurality of longitudinally extending channels.

The aerosol-cooling element may comprise a gathered sheet of material selected from the group consisting of metallic foil, polymeric material, and substantially non-porous paper or cardboard. In certain embodiments, the aerosol-cooling element may comprise a gathered sheet of material selected from the group consisting of polyethylene (PE), polypropylene (PP), polyvinylchloride (PVC), polyethylene terephthalate (PET), polylactic acid (PLA), cellulose acetate (CA), and aluminium foil.

In certain preferred embodiments, the aerosol-cooling element may comprise a gathered sheet of biodegradable polymeric material, such as polylactic acid (PLA) or a grade of Mater-Bi® (a commercially available family of starch based copolyesters).

Smoking articles according to the invention may comprise one or more aerosol modifying agents downstream of the aerosol-forming substrate. For example, one or more of the mouthpiece, transfer element and aerosol-cooling element of smoking articles according to the invention may comprise one or more aerosol modifying agents.

Suitable aerosol-modifying agents include, but are not limited to: flavourants; and chemesthetic agents.

As used herein, the term 'flavourant' is used to describe any agent that, in use, imparts one or both of a taste or aroma to an aerosol generated by the aerosol-forming substrate of the smoking article.

As used herein, the term 'chemesthetic agent' is used to describe any agent that, in use, is perceived in the oral or olfactory cavities of a user by means other than, or in addition to, perception via taste receptor or olfactory receptor cells. Perception of chemesthetic agents is typically via a "trigeminal response," either via the trigeminal nerve, glossopharyngeal nerve, the vagus nerve, or some combination of these. Typically, chemesthetic agents are perceived as hot, spicy, cooling, or soothing sensations.

Smoking articles according to the invention may comprise one or more aerosol modifying agents that are both a flavourant and a chemesthetic agent downstream of the aerosol-forming substrate. For example, one or more of the mouthpiece, transfer element and aerosol-cooling element of smoking articles according to the invention may comprise menthol or another flavourant that provides a cooling chemesthetic effect.

Smoking articles according to the invention may be assembled using known methods and machinery.

The invention will be further described, by way of example only, with reference to the accompanying drawings in which.

Figure 1:
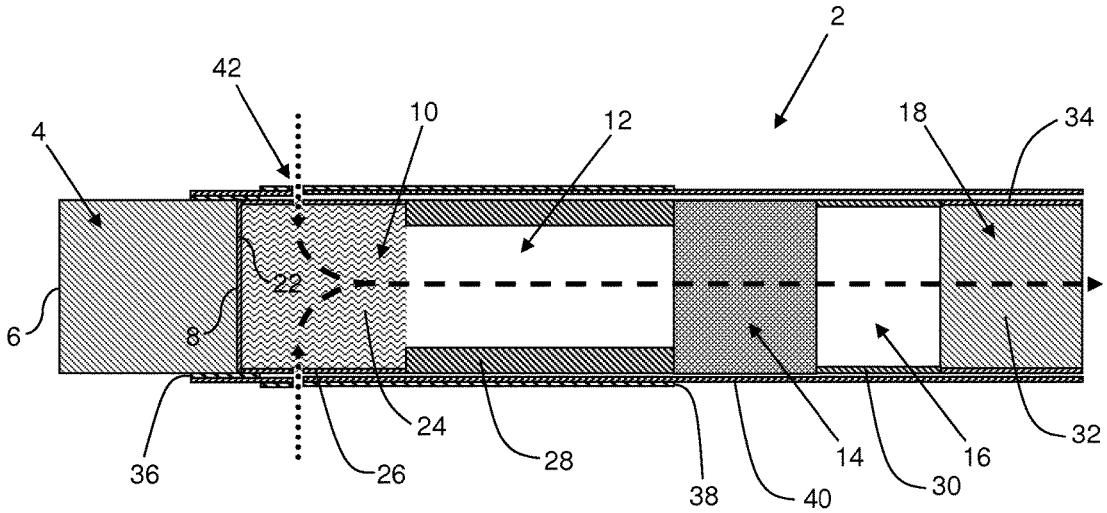
FIG. 1 shows a schematic longitudinal cross-section of a smoking article according to a first embodiment of the invention.

The smoking article 2 according to the first embodiment of the invention shown in FIG. 1 comprises a blind combustible heat source 4 having a front face 6 and an opposed rear face 8, an aerosol-forming substrate 10, a transfer element 12, an aerosol-cooling element 14, a spacer element 16 and a mouthpiece 18 in abutting coaxial alignment.

The blind combustible heat source 4 is a blind carbonaceous combustible heat source and is located at the distal end of the smoking article 2. As shown in FIG. 1, a non-combustible substantially air impermeable barrier 22 in the form of a disc of aluminium foil is provided between the rear face 8 of the blind combustible heat source 4 and the aerosol-forming substrate 10. The barrier 22 is applied to the rear face 8 of the blind combustible heat source 4 by pressing the disc of aluminium foil onto the rear face 8 of the blind combustible heat source 4 and abuts the rear face 8 of the combustible carbonaceous heat source 4 and the aerosol-forming substrate 10. It will be appreciated that in other embodiments of the invention (not shown), the non-combustible substantially air impermeable barrier 22 between the rear face 8 of the blind combustible heat source 4 and the aerosol-forming substrate 10 may be omitted.

The aerosol-forming substrate 10 is located immediately downstream of the first barrier 22 applied to the rear face 8 of the blind combustible heat source 4. The aerosol-forming substrate 10 comprises a cylindrical plug of homogenised tobacco-based material 24 including an aerosol former such as, for example, glycerine, wrapped in plug wrap 26.

The transfer element 12 is located immediately downstream of the aerosol-forming substrate 10 and comprises a cylindrical open-ended hollow cellulose acetate tube 28.

The aerosol-cooling element 14 is located immediately downstream of the transfer element 12 and comprises a gathered sheet of biodegradable polymeric material such as, for example, polylactic acid.

The spacer element 16 is located immediately downstream of the aerosol-cooling element 14 and comprises a cylindrical open-ended hollow paper or cardboard tube 30.

The mouthpiece 18 is located immediately downstream of the spacer element 16. As shown in FIG. 1, the mouthpiece 18 is located at the proximal end of the smoking article 2 and comprises a cylindrical plug of suitable filtration material 32 such as, for example, cellulose acetate tow of very low filtration efficiency, wrapped in filter plug wrap 34.

The smoking article 2 comprises a first heat-conducting element 36 comprising a radially inner layer of heat-conductive material such as, for example, aluminium foil, overlying and in direct contact with a rear portion of the blind combustible heat source 4 and a front portion of the aerosol-forming substrate 10. The smoking article 2 also comprises a second heat-conducting element 38 comprising a radially outer layer of heat-conductive material such as, for example, aluminium foil, overlying a rear portion of the aerosol-forming substrate 10 and the entire length of the transfer element 12. As shown in FIG. 1, the radially outer layer of heat-conductive material of the second heat-conducting element 38 does not overlie the radially inner layer of heat-conductive material of the first heat-conducting element 36.

In other embodiments of the invention (not shown), the first heat-conducting element 36 may comprise one or more radially inner layers of heat-conductive material that overlie a rear portion of the blind combustible heat source 4 and the second heat-conducting element 38 may comprise one or more radially outer layers of heat-conductive material that overlie the entire length of the aerosol-forming substrate 10.

Alternatively or in addition, in other embodiments of the invention (not shown), the transfer element 12 may extend beyond the one or more radially outer layers of heat-conductive material of the second heat-conducting element 38 in the downstream direction. In such embodiments, the one or more radially outer layers of heat-conductive material of the second heat-conducting element 38 may overlie only a front portion of the transfer element 12. Alternatively, in such embodiments, the one or more radially outer layers of heat-conductive material of the second heat-conducting element 38 may not overlie any of the transfer element 12.

In the first embodiment of the invention shown in FIG. 1, the position around the aerosol-forming substrate 10 to which the radially inner layer of heat-conductive material of the first heat-conducting element 36 extends in the downstream direction is approximately the same as the position around the aerosol-forming substrate 10 to which the radially outer layer of heat-conductive material of the second heat-conducting element 38 extends in the upstream direction. That is, the downstream end of the radially inner layer of heat-conductive material of the first heat-conducting element 36 and the upstream end of the radially outer layer of heat-conductive material of the second heat-conducting element 38 are substantially aligned over the aerosol-forming substrate 10. In other embodiments of the invention (not shown), the one or more radially outer layers of heat-conductive material of the second heat-conducting element 38 may be longitudinally spaced apart from the one or more radially inner layers of heat-conductive material of the first heat-conducting element 36.

The first heat-conducting element 36 and the second heat-conducting element 38 are radially separated by a layer of heat-insulative material 40 such as, for example, cigarette paper, that overlies the entire length of the radially inner layer of heat-conductive material of the first heat-conducting element 36 and underlies the entire length of the radially outer layer of heat-conductive material of the second heat-conducting element 38.

As shown in FIG. 1, the layer of heat-insulative material 40 circumscribes the radially inner layer of heat-conductive material of the first heat-conducting element 36, the aerosol-forming substrate 10, the transfer element 12, the aerosol-cooling element 14, the spacer element 16 and the mouthpiece 18.

The smoking article may further comprise a band of tipping paper (not shown) circumscribing a downstream end portion of the layer of heat-insulative material 40.

The smoking article 2 according to the first embodiment of the invention comprises one or more first air inlets 42 around the periphery of the aerosol-forming substrate 10. As shown in FIG. 1, a circumferential arrangement of first air inlets 42 is provided in the plug wrap 26 of the aerosol-forming substrate 10 and the radially outer layer of heat-conductive material of the second heat conducting element 38 to admit cool air (shown by dotted arrows in FIG. 1) into the aerosol-forming substrate 10.

In use, a user ignites the blind combustible heat source 4 of the smoking article 2 according to the first embodiment of the invention and then draws on the mouthpiece 18. When a user draws on the mouthpiece 18, cool air (shown by dotted arrows in FIGS. 1) is drawn into the aerosol-forming substrate 10 of the smoking article 2 through the first air inlets 42.

The front portion of the aerosol-forming substrate 10 is heated by conduction through the rear face 8 of the blind combustible heat source 4 and the barrier 22 and the first heat-conducting element 36. The heating of the aerosol-forming substrate 10 by conduction releases glycerine and other volatile and semi-volatile compounds from the plug of homogenised tobacco-based material 24. The compounds released from the aerosol-forming substrate 10 form an aerosol that is entrained in the air drawn into the aerosol-forming substrate 10 of the smoking article 2 through the first air inlets 42 as it flows through the aerosol-forming substrate 10. The drawn air and entrained aerosol (shown by dashed arrows in FIG. 1 pass downstream through the interior of the cylindrical open-ended hollow cellulose acetate tube 28 of the transfer element 12, the aerosol-cooling element 14 and the spacer element 16, where they cool and condense. The cooled drawn air and entrained aerosol pass downstream through the mouthpiece 18 and are delivered to the user through the proximal end of the smoking article 2 according to the first embodiment of the invention. The non-combustible substantially air impermeable barrier 22 on the rear face 8 of the blind combustible heat source 4 isolates the blind combustible heat source 4 from air drawn through the smoking article 2 such that, in use, air drawn through the smoking article 2 does not come into direct contact with the blind combustible heat source 4.

In use, the second heat-conducting element 38 reduces radiative heat losses from the outer surfaces of the smoking article 2. This in turn helps maintain the temperature of the aerosol-forming substrate 10 to facilitate continued and enhanced aerosol delivery.

It will be appreciated that in other embodiments of the invention (not shown), the smoking article may further comprise an outer wrapper of sheet material such as, for example, cigarette paper, of low air permeability, which circumscribes the aerosol-forming substrate 10, the transfer element 12, the aerosol-cooling element 14, the spacer element 16, the mouthpiece 18 and a rear portion of the blind combustible heat source 4 and which overlies the second heat-conducting element.

In such embodiments, the circumferential arrangement of first air inlets 42 is provided in the plug wrap 26 of the aerosol-forming substrate 10, the radially outer layer of heat-conductive material of the second heat conducting element 38, and the overlying outer wrapper to admit cool air (shown by dotted arrows in FIG. 1) into the aerosol-forming substrate 10.

A smoking article according to a second embodiment of the invention (not shown) is of largely identical construction to the smoking article according to the first embodiment of the invention shown in FIG. 1. However, in the smoking article according to the second embodiment of the invention, the layer of heat-insulative material 40 overlying the first heat-conducting element 36 and underlying the second heat-conducting element 38 is omitted and the second heat-conducting element 38 is formed of a laminate material comprising an outer layer of heat-conductive material such as, for example, aluminium, and an inner layer of heat-insulative material such as, for example, paper.

Figure 2:
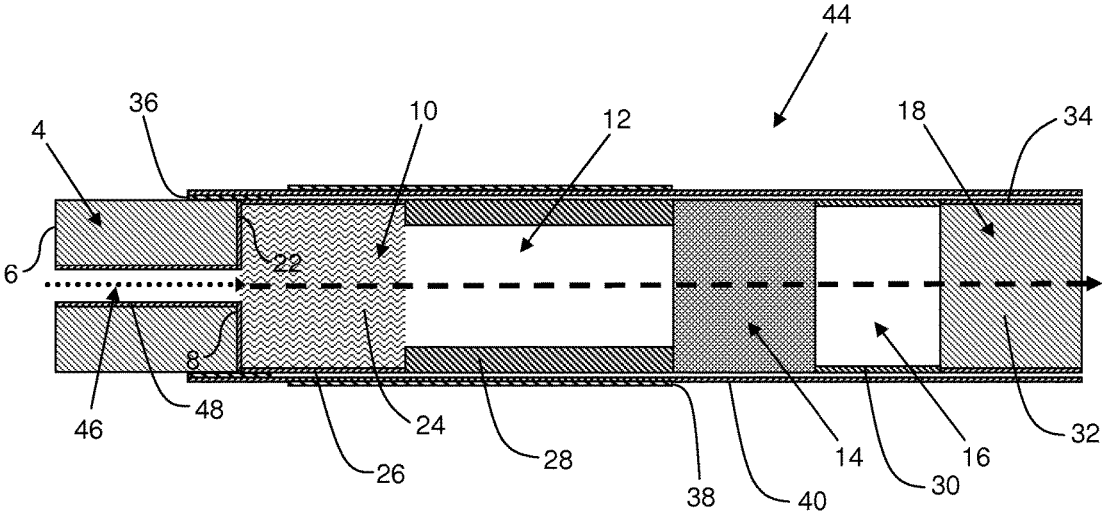
FIG. 2 shows a schematic longitudinal cross-section of a smoking article according to a third embodiment of the invention.

The smoking article 44 according to the third embodiment of the invention shown in FIG. 2 is of largely identical construction to the smoking article according to the first embodiment of the invention shown in FIG. 1. However, in the smoking article 44 according to the third embodiment of the invention, the first air inlets 42 around the periphery of the aerosol-forming substrate 10 are omitted and the combustible heat source 4 is a non-blind combustible carbonaceous heat source comprising a single central airflow channel 46 extending from the front face 6 to the rear face 8 of the non-blind combustible heat source 4.

As shown in FIG. 2, a non-combustible substantially air impermeable barrier 48 is provided between the combustible heat source 4 and the central airflow channel 46. The barrier 48 comprises a non-combustible substantially air impermeable barrier coating provided on the entire inner surface of the single central airflow channel 46. In other embodiments of the invention (not shown), the non-combustible substantially air impermeable barrier 48 between the combustible heat source 4 and the central airflow channel 46 may be omitted.

Like the smoking article according to the first embodiment of the invention shown in FIG. 1, the smoking article 44 according to the third embodiment of the invention shown in FIG. 2 comprises a first heat-conducting element 36 comprising a radially inner layer of heat-conductive material overlying and in direct contact with a rear portion of the blind combustible heat source 4 and a front portion of the aerosol-forming substrate 10 and a second heat-conducting element 38 comprising a radially outer layer of heat-conductive material overlying the a rear portion of the aerosol-forming substrate 10 and the entire length of the transfer element 12. However, as shown in FIG. 1, in the smoking article 44 according to the second embodiment of the invention, the radially outer layer of heat-conductive material of the second heat-conducting element 38 is longitudinally spaced apart from the radially inner layer of heat-conductive material of the first heat-conducting element 36.

In use, a user ignites the non-blind combustible heat source 4 of the smoking article 44 according to the second embodiment of the invention and then draws on the mouthpiece 18. When a user draws on the mouthpiece 18, cool air (shown by dotted arrows in FIG. 2) is drawn into the aerosol-forming substrate 10 of the smoking article 2 through the central airflow channel 46. The non-combustible substantially air impermeable barrier 22 on the rear face 8 of the non-blind combustible heat source 4 and the non-combustible substantially air impermeable barrier 48 on the inner surface of the single central airflow channel 46 isolate the non-blind combustible heat source 4 from air drawn through the smoking article 44 such that, in use, air drawn through the smoking article 44 does not come into direct contact with the non-blind combustible heat source 4.

A smoking article according to a fourth embodiment of the invention (not shown) is of largely identical construction to the smoking article according to the third embodiment of the invention shown in FIG. 2. However, in the smoking article according to the third embodiment of the invention, the layer of heat-insulative material 40 overlying the first heat-conducting element 36 and underlying the second heat-conducting element 38 is omitted and the second heat-conducting element 38 is formed of a laminate material comprising an outer layer of heat-conductive material such as, for example, aluminium, and an inner layer of heat-insulative material such as, for example, paper.

Figure 3:
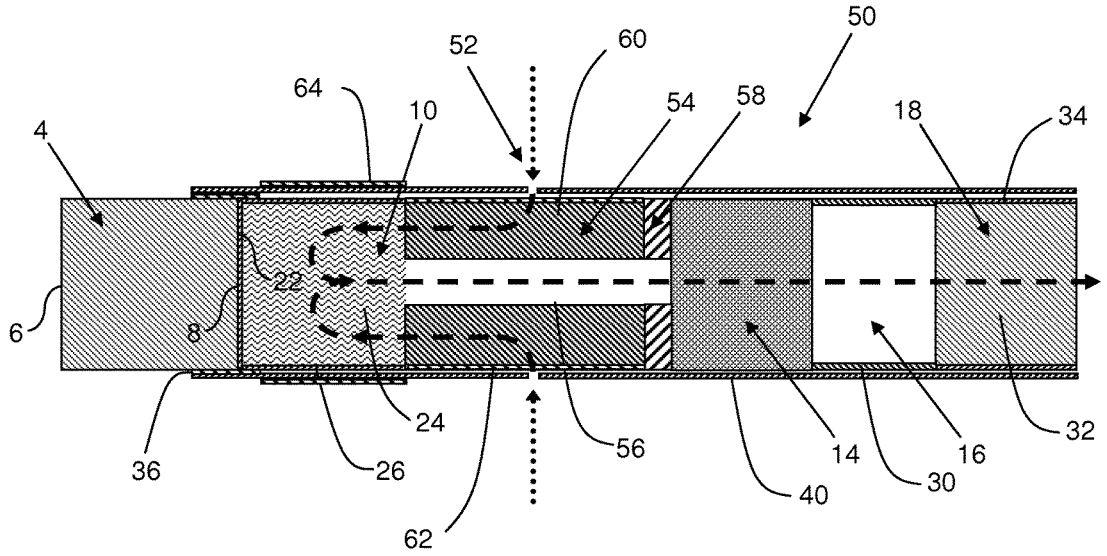
FIG. 3 shows a schematic longitudinal cross-section of a smoking article according to a fifth embodiment of the invention.

The smoking article 50 according to the fifth embodiment of the invention shown in FIG. 3 is of largely identical construction to the smoking article according to the first embodiment of the invention shown in FIG. 1. However, in the smoking article 50 according to the fifth embodiment of the invention, the first air inlets 42 around the periphery of the aerosol-forming substrate 10 and the transfer element 12 are omitted, being replaced by third air inlets 52 and an airflow directing element 54 respectively.

The airflow directing element 54 is located downstream of the aerosol-forming substrate 10 and comprises an open-ended, substantially air impermeable hollow tube 56 made of, for example, cardboard, which is of reduced diameter compared to the aerosol-forming substrate 10. The upstream end of the open-ended hollow tube 56 abuts the aerosol-forming substrate 10. The downstream end of the open-ended hollow tube 56 is surrounded by an annular substantially air impermeable seal 58 of substantially the same diameter as the aerosol-forming substrate 10. The remainder of the open-ended hollow tube is embedded in a cylindrical plug of cellulose acetate tow 60 of substantially the same diameter as the aerosol-forming substrate 10.

The open-ended hollow tube 56 and cylindrical plug of cellulose acetate tow 60 are circumscribed by an air permeable inner wrapper 62.

As also shown in FIG. 3, a circumferential row of the third air inlets 52 are provided in the layer of heat-insulative material 40 circumscribing the inner wrapper 62.

In use, when a user draws on the mouthpiece 10, cool air is drawn into the smoking article 50 according to the second embodiment of the invention through the third air inlets 52. The drawn air passes upstream between the exterior of the open-ended hollow tube 56 and the inner wrapper 62 through the cylindrical plug of cellulose acetate tow 60 to the aerosol-forming substrate 10.

As in the smoking article 2 according to the first embodiment of the invention shown in FIG. 1 and described above, the aerosol-forming substrate 10 is heated by conduction to form an aerosol that is entrained in the drawn air as it flows through the aerosol-forming substrate 10. The drawn air and entrained aerosol pass downstream through the interior of the hollow tube 56 of the airflow directing element 54 to the aerosol-cooling element 14 and the spacer element 16, where they cool and condense. The cooled aerosol then passes downstream through the mouthpiece 18 of the smoking article 50 into the mouth of the user.

The aerosol-cooling element 14 is located immediately downstream of the airflow directing element 54 and, similarly to the first embodiment, comprises a gathered sheet of biodegradable polymeric material such as, for example, polylactic acid.

The spacer element 16 is located immediately downstream of the aerosol-cooling element 14 and comprises a cylindrical open-ended hollow paper or cardboard tube 30.

The mouthpiece 18 is located immediately downstream of the spacer element 16. As shown in FIG. 3, the mouthpiece 18 is located at the proximal end of the smoking article 50 and comprises a cylindrical plug of suitable filtration material 32 such as, for example, cellulose acetate tow of very low filtration efficiency, wrapped in filter plug wrap 34.

The non-combustible substantially air impermeable barrier coating 22 provided on the entire rear face of the combustible carbonaceous heat source 4 isolates the combustible carbonaceous heat source 4 from the airflow pathways through the smoking article 50 such that, in use, air drawn through the smoking article 50 along the airflow pathways does not directly contact the combustible carbonaceous heat source 4.

As described with reference to the first embodiment shown in FIG. 1, in use, the second heat-conducting element 64 reduces radiative heat losses from the outer surfaces of the smoking article 50. This in turn helps maintain the temperature of the aerosol-forming substrate 10 to facilitate continued and enhanced aerosol delivery. As can be seen with reference to FIG. 3, the second heat-conducting element 64 only overlies the aerosol-forming substrate 10 and not the transfer element 12 as in the embodiment described with reference to FIG. 1.

A smoking article according to a sixth embodiment of the invention (not shown) is of largely identical construction to the smoking article according to the fifth embodiment of the invention shown in FIG. 3. However, in the smoking article according to the fifth embodiment of the invention, the layer of heat-insulative material 40 overlying the first heat-conducting element 36 and underlying the second heat-conducting element 64 is omitted and the second heat-conducting element 64 is formed of a laminate material comprising an outer layer of heat-conductive material such as, for example, aluminium, and an inner layer of heat-insulative material such as, for example, paper.

The specific embodiments shown in the Figures and described above are intended to illustrate the invention. However, other embodiments may be made without departing from the spirit and scope of the invention as defined in the claims, and it is to be understood that the specific embodiments described above are not intended to be limiting.

The invention claimed is:

1. A smoking article, comprising:

a combustible heat source having opposed front and rear faces;

an aerosol-forming substrate downstream of the rear face of the combustible heat source;

a first heat-conducting element comprising one or more radially inner layers of heat-conductive material overlying a rear portion of the combustible heat source; and a second heat-conducting element comprising one or more radially outer layers of heat-conductive material overlying at least a portion of the aerosol-forming substrate, wherein a radial distance between a longitudinal axis of the smoking article and the one or more radially outer layers of heat-conductive material is greater than a radial distance between the longitudinal axis of the smoking article and the one or more radially inner layers of heat-conductive material, and wherein the one or more radially outer layers of heat-conductive material do not overlie the one or more radially inner layers of heat-conductive material.

2. The smoking article according to claim 1, wherein the one or more radially inner layers of heat-conductive material overlying the rear portion of the combustible heat source also overlie a front portion of the aerosol-forming substrate, and wherein the one or more radially outer layers of heat-conductive material also overlie a rear portion of the aerosol-forming substrate.

3. The smoking article according to claim 1, wherein the one or more radially outer layers of heat-conductive material overlie an entire length of the aerosol-forming substrate.

4. The smoking article according to claim 1, wherein the one or more radially outer layers of heat-conductive material of the second heat-conducting element are longitudinally spaced apart from the one or more radially inner layers of heat-conductive material of the first heat-conducting element.

5. The smoking article according to claim 1, wherein the second heat-conducting element is formed of a laminate material comprising one or more layers of heat-conductive-material and one or more layers of heat-insulative material.

6. The smoking article according to claim 1, wherein the second heat-conducting element comprises one or more layers of heat-reflective material.

7. The smoking article according to claim 6, wherein the heat-reflective material reflects more than 50% of incident radiation.

8. The smoking article according to claim 1, wherein the first heat-conducting element and the second heat-conducting element are radially separated by one or more layers of heat-insulative material.

9. The smoking article according to claim 1, further comprising an outer wrapper around at least a portion of the second heat-conducting element.

10. The smoking article according to claim 1, wherein a radially outer layer of heat-conductive material of the one or more radially outer layers is provided on an outside of the smoking article, such that the radially outer layer of heat-conductive material is visible on an exterior of the smoking article.

11. The smoking article according to claim 1, further comprising a non-combustible substantially air impermeable barrier between the rear face of the combustible heat source and the aerosol-forming substrate.

12. The smoking article according to claim 1, wherein the combustible heat source is a blind combustible heat source.

13. The smoking article according to claim 1, further comprising one or more airflow channels extending from the front face to the rear face of the combustible heat source.

14. The smoking article according to claim 13, further comprising a non-combustible substantially air impermeable barrier between the combustible heat source and the one or more airflow channels.

15. The smoking article according to claim 1, further comprising one or more air inlets around a periphery of the aerosol-forming substrate.

16. The smoking article according to claim 1, wherein the aerosol-forming substrate is spaced apart from the rear face of the combustible heat source.

17. The smoking article according to claim 16, further comprising one or more air inlets between the rear face of the combustible heat source and the aerosol-forming substrate.

18. The smoking article according to claim 1, further comprising one or more air inlets downstream of the aerosol-forming substrate.

19. The smoking article according to claim 1, further comprising one or more aerosol modifying agents downstream of the aerosol-forming substrate.

* * * * *